US006382785B2

(12) United States Patent
Inada et al.

(10) Patent No.: US 6,382,785 B2
(45) Date of Patent: May 7, 2002

(54) REPLACEABLE INK CARTRIDGE AND SEAL STRUCTURE THEREOF

(75) Inventors: Genji Inada; Masami Ikeda, both of Yokohama; Tsutomu Abe, Isehara; Hiroyuki Ishinaga, Tokyo; Masahiko Higuma, Togane; Yoichi Taneya, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/294,213

(22) Filed: Apr. 20, 1999

Related U.S. Application Data

(62) Division of application No. 08/453,148, filed on May 30, 1995, now Pat. No. 6,164,769.

(30) Foreign Application Priority Data

May 31, 1994 (JP) ..... 6-119279
Jul. 11, 1994 (JP) ..... 6-159045

(51) Int. Cl.[7] ..... B41J 2/175; B65D 69/00
(52) U.S. Cl. ..... 347/86; 206/576
(58) Field of Search ..... 347/85–87, 84, 347/108; 220/240, 360, 359, 368, 601, 255, 253; 206/576, 813, 466

(56) References Cited

U.S. PATENT DOCUMENTS 3,302,818 A * 2/1967 Balocca et al. ..... 220/231
3,441,167 A * 4/1969 Balocca ..... 220/271
4,029,033 A 6/1977 Kerwin et al. ..... 220/359
5,231,416 A 7/1993 Terasawa et al. ..... 347/23
5,701,995 A 12/1997 Higuma et al. ..... 347/86
5,831,652 A * 11/1998 Hinami et al. ..... 347/86
5,940,104 A * 8/1999 Karita et al. ..... 347/87
6,113,230 A * 9/2000 Ishinaga et al. ..... 347/86

FOREIGN PATENT DOCUMENTS

| | | | |
|---|---|---|---|
| EP | 418828 | 3/1991 | |
| EP | 627317 | 12/1994 | |
| EP | 638426 | 2/1995 | |
| JP | 5-162326 | 6/1993 | ..... 347/86 |
| JP | 6-328712 | 11/1994 | |
| JP | 7-205439 | 8/1995 | |
| JP | 7-315437 | 12/1995 | |

* cited by examiner

*Primary Examiner*—Judy Nguyen
(74) *Attorney, Agent, or Firm*—Fitzpatrick, Cella, Harper & Scinto

(57) ABSTRACT

A replaceable ink cartridge has a body for storing the ink; an ink outlet for supplying the ink into a recording head; an air communicating port for communicating with an atmosphere; a peripheral portion around the ink outlet; a peripheral portion around the air communicating port; a seal member for removably sealing the peripheral portion around the ink outlet and the peripheral portion around the air communicating port. The replaceable ink cartridge has a structure that is formed so as to strip the seal member off from the peripheral portions of the ink outlet and the air communicating port in a manner that the air communicating port is opened at first and the ink outlet is opened at second.

9 Claims, 17 Drawing Sheets

REPLACEABLE INK CARTRIDGE AND SEAL STRUCTURE THEREOF

This application is a division of application Ser. No. 08/453,148, filed May 30, 1995 now U.S. Pat. No. 6,164, 769.

BACKGROUND OF THE INVENTION

1. Field of the Invention

The present invention relates generally to a replaceable ink cartridge, and more particularly to a replaceable ink cartridge to be replaceably connected to a recording head into which ink is supplied therefrom. Also, the present invention relates to a seal structure to seal openings of the replaceable ink cartridge, and more particularly to a seal structure with improved properties of sealing an ink outlet and an air communicating port of the replaceable ink cartridge.

2. Description of the Related Art

Heretofore, various kinds of recording apparatus for performing an image formation on a recording medium such as a sheet of recording paper, a piece of fabric, and a sheet of plastic material e.g., one used for overhead projector (generally called as a OHP sheet) have been proposed as in the form of mounting a recording head in the type of wire dot matrix recording, thermal recording, thermal transfer recording, ink jet recording, or the like. Among the conventional recording methods, the ink jet recording apparatus having a recording head in the type of performing ink jet method has been used as various kinds of recording (printing) system so as to being commercially available. In this case, the ink jet recording head should be constructed to meet the user's demands of the mechanism, configuration, application and the like of the individual system.

The ink jet recording apparatus generally comprises: a carriage for carrying a recording means (i.e., a recording head) and an ink tank; a transfer means for transferring a recording medium (e.g., a sheet of recording paper); and a control means for controlling the drive of these means. In the ink jet recording apparatus, the ink jet recording head performs its serial scanning movement (i.e., the head scans over a surface of the recording head sequentially) along the direction (main-scanning direction) perpendicular to the direction (sub-scanning direction) of transmitting the recording medium for ejecting ink droplets from a plurality of ejection orifices, while the recording medium is intermittently shifted at a distance corresponding to a recording width of the recording medium. The process of ink jet recording is characterized by ejecting ink droplets on the recording medium in accordance with the recording signals, so that it has been widely applied in various systems as a noiseless recording process with an inexpensive running cost. By using the recording head comprising a plurality of ink-ejecting nozzles linearly arranged in the sub-scanning direction, an image having a width thereof corresponding to the number of the nozzles can be recorded by a single scanning movement of the recording head. Consequently, the high-speed recording movement can be attained.

In the case of an ink jet recording apparatus adaptable to a full color image formation, furthermore, each of recording heads corresponding to several colors ejects a color ink droplets, so that each of all colors is obtainable by placing ink droplets one upon another. Generally, three or four recording heads with ink tanks corresponding to three primary colors of yellow (Y), magenta (M), and cyan (C) and a color of black (B) are required for recording the color image. In recent years, an ink jet recording apparatus that carries recording heads corresponding to these three or four colors has been practically used for full color image formation.

Furthermore, the ink jet recording apparatus as mentioned above can be constructed with a relatively easily manner so as to fit to the process of recording a larger sized image such as a A1 sized one. For recording a A1 sized color image, the recording apparatus has been practically provided so as to be able to connect with an image reader for making a copy of original. This kind of the apparatus is provided as, for example a plotter such as an output printer of computer-aided design (CAD) system. On the other hand, diversified demands of recording images on various kinds of recording medium have been increased. For example, a demand of recording an image on the OHP sheet by the ink jet recording apparatus has been increased because the OHP sheet can be used in a system of projecting the image for giving a presentation in a lecture, a conference, a meeting, or the like. For a request to the above demand, another kind of the ink jet recording apparatus has been developed and provided in practical use. That is, this recording apparatus is constructed to perform an excellent image formation without depending on a result of selecting and using one of various recording media having different properties of absorbing ink.

Accordingly, the aforementioned ink jet recording apparatus has been regarded as an excellent recording means and required as useful in widely distributed industrial fields, for example apparel and textile industries. Furthermore, there is a demand of providing a further improved qualities of images in these fields.

In an ink jet recording head (hereafter, also referred as a recording head) to be installed on the ink jet recording apparatus, by the way, means for generating energy required for ejecting ink can be exemplified by a recording element of the type having an electromechanical transducer such as a piezo element or the like used therefor, and a recording element of the type adapted to heat liquid with the aid of an electrothermal converting element including a heat generating resistor.

Among various kinds of recording heads, a recording head of the type adapted to eject liquid therefrom by utilizing thermal energy makes it possible to perform a recording operation with a high degree of resolution because a plurality of liquid ejection ports can be arranged on the recording head at a high density.

By the way, there are several types of the characteristic configuration for supplying ink to the aforementioned recording head, such as one connecting the recording head with the ink tank by means of a flexible tube, one directly connecting them as an integrated unit to be replaceably installed on the recording apparatus, and one removable connecting them each other. Especially in the recent years, the number of the recording apparatuses using the type of removable connecting the recording head and the ink tank to form a unit has been increased.

An replaceable ink cartridge to be removably connected with the recording head to form such unit comprises a main body made of a plastic material or the like on which an ink outlet and an air communicating port are formed. The ink outlet is for supplying an ink to the recording head while the air communicating port is for communicating with the open air. For the purpose of its physical distribution, these openings are sealed up with a seal member after filling the body with ink to prevent an ink leakage from the body under the changeable environmental conditions such as, a physical vibration, a surrounding temperature and an atmospheric pressure. At the time of using the ink cartridge, the seal member is peeled off. At this moment, furthermore, the seal member receives a tension and a shear stress, so that the seal member should be made of a proof material with respect to such forces, such as a flexible material, for example an aluminum laminate resin formed by laminating an aluminum thin film and a resin material.

By the way, it is noted that the ink outlet and the air communicating port are sealed by a single piece of the seal member from the point of view that the seal member should be easily peeled off from these openings.

Mostly, the replaceable ink cartridge as described above is constructed so as to keep ink in an ink absorber being installed in the ink cartridge's body. In this case, in addition, the ink absorber occupies a predetermined space of an interior of the body to make a concentration of ink around the ink outlet for easily providing the ink to the recording head and also to avoid a concentration of ink to the air communicating port.

In some instances, conventionally, the ink outlet can be sealed off at first when the user pulls an end of the seal member toward a certain direction. When the ink outlet is opened at first prior to open the air communicating port, a certain amount of ink scatters in all directions at an inner pressure of the cartridge which is higher than an atmospheric pressure by a change in temperature and atmospheric condition. As a consequence, the scattered ink stains the user's hands and clothes. Furthermore, in the case that a gaseous body such as air is sealed up hermetically with ink in the ink cartridge, the above problem is more serious because there is the possibility that ink scatters from the ink outlet in all directions at an increased inner pressure of the cartridge occurred by swelling the gaseous body.

SUMMARY OF THE INVENTION

It is an object of the present invention to provide a replaceable ink cartridge with a high degree of reliability, without causing a scattering of ink from an ink outlet at the time of sealing off and a leak of ink therefrom during physical distribution.

Another object of the present invention is to provide: a replaceable ink cartridge having an ink outlet and an air communicating port which are sealed by a piece of seal member; and a package in which the replaceable ink cartridge is packed for the purpose of storage or transportation. In this case, the replaceable ink cartridge is constructed so as to seal off the air communicating port at first at the time of pulling the seal member out from the cartridge.

A further object of the present invention is to provide a replaceable ink cartridge for supplying ink to a recording means for recording an image on a recording medium. In this case, the ink cartridge can be removably connected with the recording head. Besides, the ink cartridge comprises an enclosure for storing ink; an ink outlet and an air communicating port, both formed on the enclosure; an ink outlet peripheral portion formed around the ink outlet; and an air communicating port peripheral portion formed around the air communicating port. Under the unused condition, furthermore, the ink cartridge further comprises a seal member for sealing the peripheral portions around the ink outlet and the air communicating port. The ink cartridge is constructed so as to peel the seal member from the both peripheral portions around the ink outlet and the air communicating port in a manner that the air communicating port is opened at first and then the ink outlet is opened next.

Still a further object of the invention is to provide a seal structure for a replaceable ink cartridge for supplying ink to a recording means for recording an image on a recording medium. In this case, the ink cartridge can be removably connected with the recording head. The ink cartridge comprises: an enclosure for storing ink; an ink outlet and an air communicating port, formed on the enclosure; an ink outlet peripheral portion formed around the ink outlet; and an air communicating port peripheral portion formed around the air communicating port. Furthermore, the sealing structure comprises: a first seal portion for sealing an opening of the ink outlet; a second seal portion for sealing an opening of the air communicating port; and a handling portion which tends to provide a peel force thereof to the first seal portion at first rather than the second seal portion.

An even further object of this invention is to provide a replaceable ink cartridge having an ink outlet and an air communicating port on an enclosure, which is constructed so as to seal peripheral portions of the ink outlet and an air communicating port by removably bring a piece of seal member into absolute contact with these peripheral portions. In this case, the peripheral portions of the ink outlet and an air communicating port are constructed so as to peel the seal member from these peripheral portions in a manner that the air communicating port is opened at first and then the ink outlet is opened next when the seal member is pulled off in the predetermined direction.

In a first aspect of the present invention, there is provided a replaceable ink cartridge to be removably connected with a recording means, for supplying ink into the recording means for recording an image on a recording medium, having an ink cartridge body for storing ink; an ink outlet and an air communicating port formed on the ink cartridge body; an ink outlet peripheral portion formed around the ink outlet; and an air communicating port peripheral portion formed around the air communicating port, the replaceable ink cartridge comprising:

- a seal member for removably sealing the ink outlet peripheral portion and the air communicating port peripheral portion when the replaceable ink cartridge is being out of use, and
- a structure which is provided so as to open the air communicating port prior to open the ink outlet at the time of stripping off the seal member from the ink outlet peripheral portion and the air communicating port peripheral portion.

A start position to strip the seal member from the air communicating port peripheral portion may be in front of a start position to strip the seal member from the ink outlet peripheral portion in a direction of striping the seal member.

The air communicating port peripheral portion may have a high facility in stripping the seal member compared with that of the ink outlet peripheral portion in a predetermined direction of striping the seal member.

An outer edge of the air communicating port peripheral portion may be in front of an outer edge of the ink outlet peripheral portion in an predetermined direction of striping the seal member.

An inner edge of the air communicating port peripheral portion may be in front of an inner edge of the ink outlet peripheral portion in a predetermined direction of striping the seal member.

The seal member may have a point of applying a stripping force in a region near the air communicating port than the ink outlet when the seal member is stripped off.

An inner diameter or a maximum inner width of the ink outlet peripheral portion may be smaller than that of an inner diameter or a maximum inner width of the ink outlet peripheral portion.

A thickness of the ink outlet peripheral portion may be larger than a thickness of the air communicating peripheral portion.

A strip resist ability between an opening of the air communicating port and the seal member may be smaller than a strip resist ability between an opening of the ink outlet and the seal member.

The ink cartridge body may be packed in a package.

In a second aspect of the present inventions there is provided a seal structure for removably sealing an ink outlet peripheral portion and an air communicating port peripheral portion of a replaceable ink cartridge to be removably connected with a recording means, for supplying ink into the recording means for recording an image on a recording medium, the replaceable ink cartridge having an ink cartridge body for storing the ink; an ink outlet and an air communicating port formed on the ink cartridge body; the ink outlet peripheral portion formed around the ink outlet; and the air communicating port peripheral portion formed around the air communicating port, the seal structure comprising:

a seal portion for sealing an opening of the ink outlet and an opening of the air communicating port by sticking on the ink outlet peripheral portion and the air communicating port peripheral portion; and a handling portion for peeling off the seal structure, wherein the seal portion of the seal structure has a first seal portion for sealing the opening of the ink outlet; and a second seal portion for sealing the opening of the air communicating port, and the handling portion is constituted so as to easily transfer a force of peeling the sealing structure to be generated by the handling portion to the second seal portion that seals the opening of the air communication port rather than the first seal portion that seals the opening of the ink outlet.

A length between the second seal portion and the handling portion may be shorter than a length between the first seal portion and the handling portion in the sealing structure.

The seal structure may be packed in a package in a condition that the seal structure is being fixed on the replaceable ink cartridge.

In a third aspect of the present invention, there is provided a replaceable ink cartridge having an ink outlet and an air communicating port in an ink cartridge body with a seal member removably sealing on both peripheral portions of the ink outlet and the air communicating port, wherein the peripheral portions of the ink outlet and the air communicating port are constructed so as to strip the seal member from the air communicating port prior to strip the seal member from the ink outlet in a direction of striping the seal member.

A start of peeling the seal member from the peripheral portion around the air communicating port may be prior to a start of peeling the seal member from the peripheral portion around the ink outlet.

A start position to strip the seal member from the peripheral portion around the air communicating port may be in front of a start position to strip the seal member from the peripheral portion around the ink outlet in a direction of striping the seal member.

The peripheral portion around the air communicating port may be in a shape of easily stripping off the seal member compared with the peripheral portion around the ink outlet in a predetermined direction of striping the seal member.

An outer edge of the peripheral portion around the air communicating port may be in front of an outer edge of the peripheral portion around the ink outlet in a predetermined direction of striping the seal member.

An inner edge of the peripheral portion around the air communicating port may be in front of an inner edge of the peripheral portion around the ink outlet in a predetermined direction of striping the seal member.

The seal member having an elongated portion may be connected with a portion of a package for packing the ink cartridge body, and the elongated portion and the package are restricted in a predetermined direction of striping the seal member when the package is opened.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The present invention will now be described in detail hereinafter with reference to the accompanying drawings in which same reference numbers denote same constituents.

First Preferred Embodiment

Figure 1A:
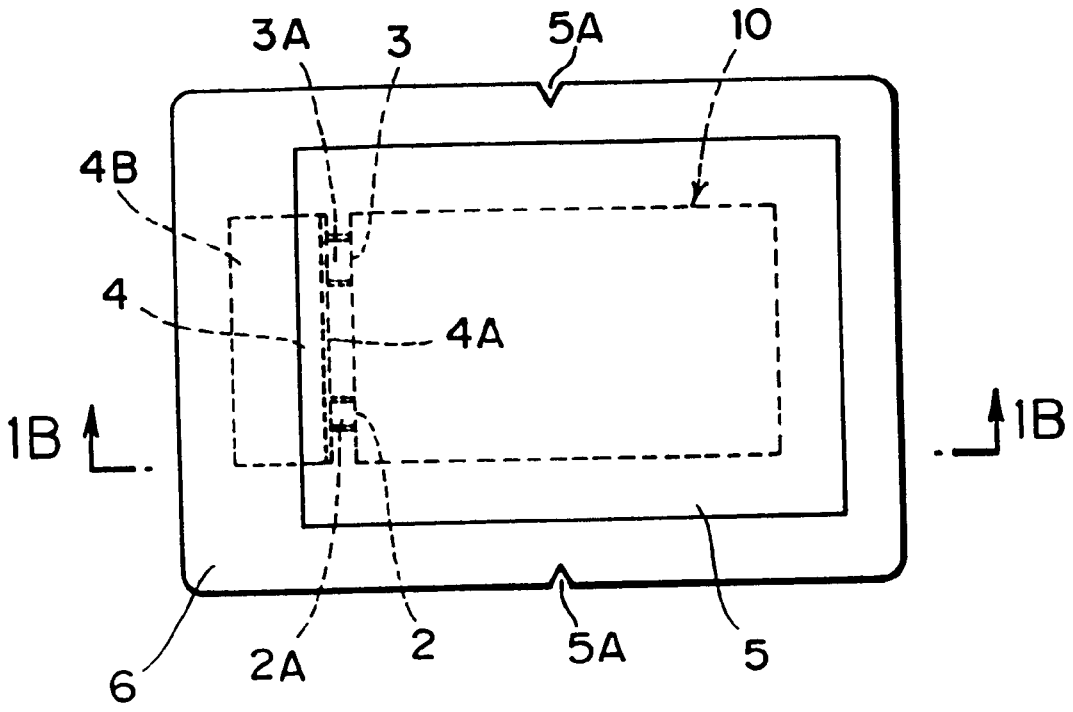
FIG. 1A is a schematic perspective diagram of an exemplified package of ink cartridge for explaining a basic construction of a first preferred embodiment of the present invention.
Figure 1B:
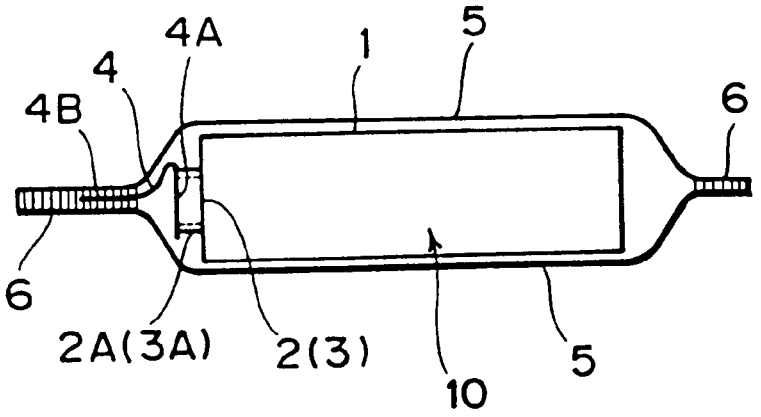
FIG. 1B is a sectional view taken substantially along the lines 1B—1B of FIG. 1A.

A replaceable ink cartridge and a package thereof in accordance with the present invention are illustrated in FIG. 1A and FIG. 1B.

An ink-jet cartridge 10 comprises an ink outlet 2 and an air communicating port 3 which are sealed off by a seal member just before using by the user after supplying from a supplier. Therefore, the seal member 4 cannot be removed by the time of connecting the cartridge 10 with a recording head. In this embodiment, the seal member 4 is combined with a package 5, so that the seal member 4 is peeled off when the package 5 is pulled into pieces by force.

The package 5 is hermetically sealed by welding its boundaries. For taking the ink cartridge out of the package 5, each longitudinal boundary portion (peripheral portion 6) of the package 5 has a chipped portion 5A which are formed so as to avoid any influence on sealed portions when the package 5 is pulled into pieces by force at the chipped portion 5A. In this embodiment, there are sealed portions: one between the seal member 4 and the ink outlet 2; and another between the seal member 4 and the air communicating port 3.

Around openings of the ink outlet 2 and the air communicating port 3, collar ribs 2A and 3A are formed, respectively. Each of these collar ribs 2A and 3A is in the shape of a cylinder. As shown in the figure, furthermore, the collar ribs 2A and 3A have the same height in the same plane of the cartridge body 1 and they are arranged substantially along a longitudinal central line of that plane.

It is preferable to use the seal member 4 having a sufficient strength with respect to a stretch or the like, so that it is made of a flexible complex material comprising a single plastic film, a layered plastic films, or the like. It is also preferable that the seal member 4 has at least two weldable parts for connecting with end surfaces of the collar ribs 2A and 3A, respectively.

FIG. 1B shows a connected part among the seal member 4, the package 5, and the collar rib 2A (3A). A welding between the end of the collar rib 2A (3A) and a weldable seal portion 4A formed on one side of the seal member 4 makes it possible to seal the ink outlet 2 and the air communicating port 3 to keep ink inside without a chance to leak. Another end 4B of the seal member 4 is bent and extended to the edge of the package 5, so that the former is supported by the latter.

The package 5 is provided as in the form of a bag made up of two sheets of paper-like material, where the ink cartridge 1 sealed with the seal member 4 is held in after the sealing. In this case, the extended portion 4B of the seal member 4 is fixed with the peripheral portion 6 of the package 5.

Figure 2:
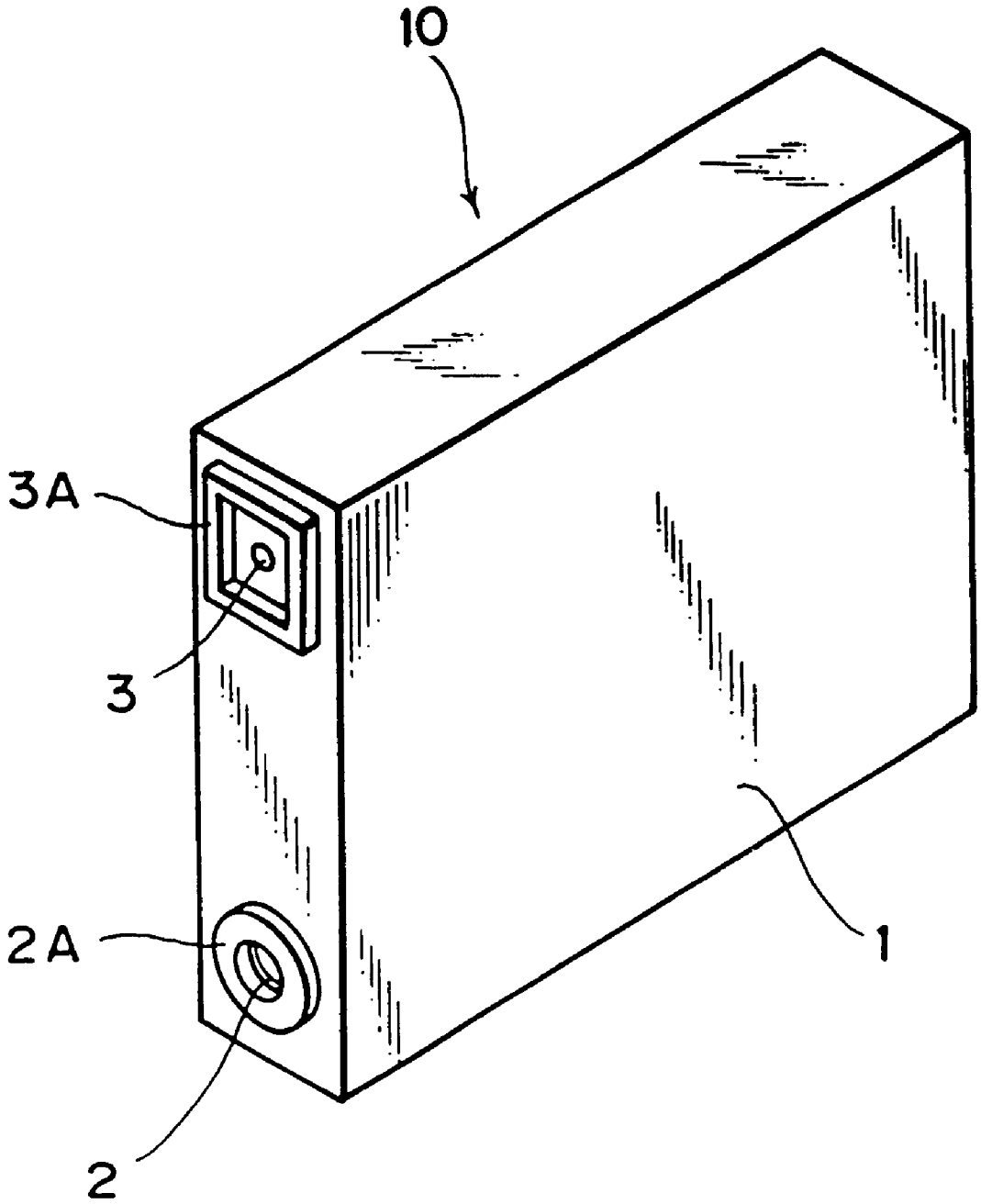
FIG. 2 is a perspective view of a replaceable ink cartridge in accordance with present invention.

An external appearance of the ink cartridge itself is shown in FIG. 2. In the figure, an external form of the collar rib 2A of the ink outlet 2 is smaller than that of the collar rib 3A of the air communicating port 3. In addition, the collar rib 2A is thicker than the collar rib 3A.

Figure 3A:
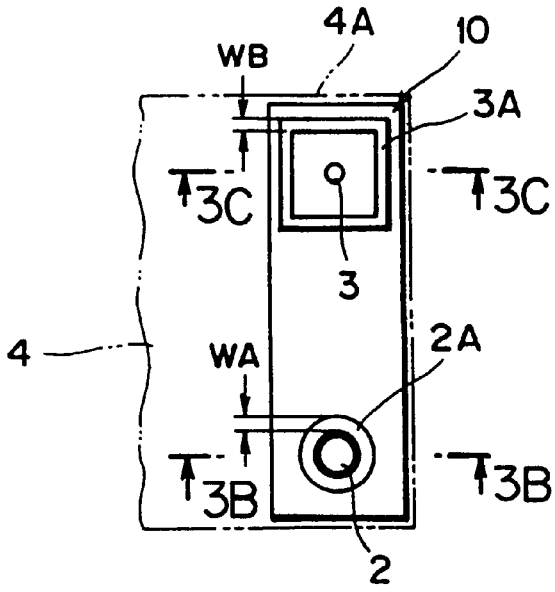
FIG. 3A is a plan view of a sealing surface of a replaceable ink cartridge for explaining a sealing condition by a seal member in accordance with the present invention.
Figure 3B:
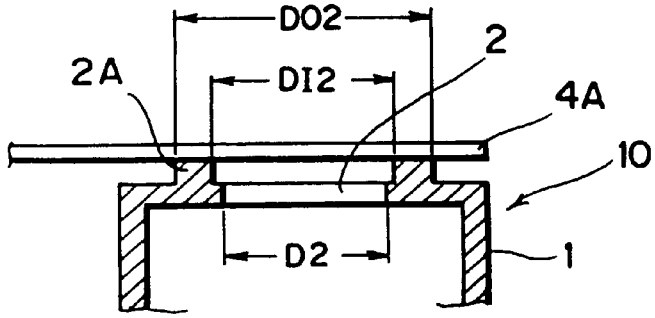
FIG. 3B is a sectional view taken substantially along the lines 1B—1B of FIG. 3A.
Figure 3C:
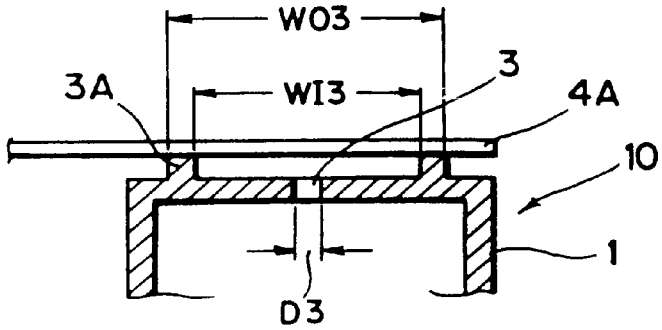
FIG. 3C is a sectional view taken substantially along the lines 3C—3C of FIG. 3A.

FIGS. 3A to 3C are illustrations for explaining the construction of the ink outlet 2, the air communicating port 3, and their peripheral portions (the collar ribs 2A and 3A) of the ink cartridge 10 shown in FIG. 2. FIG. 3A is a front view, FIGS. 3B and 3C are cross sectional views taken on lines 1B—1B and 3C—3C of FIG. 3A, respectively.

In this embodiment, the collar rib 2A around the ink outlet 2 is in the shape of cylinder being concentric with the ink outlet 2 while the collar rib 3A around the air communicating port 3 is in the shape of square. Furthermore, an opening of the collar rib 3A is larger than that of the collar rib 2A while a thickness WA of the collar rib 2A is smaller than a thickness WB of the collar rib 3A so as to obtain the relation of:

$$WO3 \geqq DO2,$$

and $$WI3 \geqq DI2$$

wherein DO2 means an outer diameter of the collar rib 2A; DI 2 means an inner diameter of the collar rib 2A; WO3 means an outer width of the collar rib 3A; and WI3 means an inner width of the collar rib 3A. As shown in FIGS. 3B and 3C, however, a diameter D2 of the ink outlet 2 is extremely larger than a diameter D3 of the air communicating port 3.

The above construction of the ink cartridge is for physically communicating the air communicating port 3 with the atmosphere prior to open the ink outlet 2. Another embodiment of such construction will be explained later.

Figure 4:
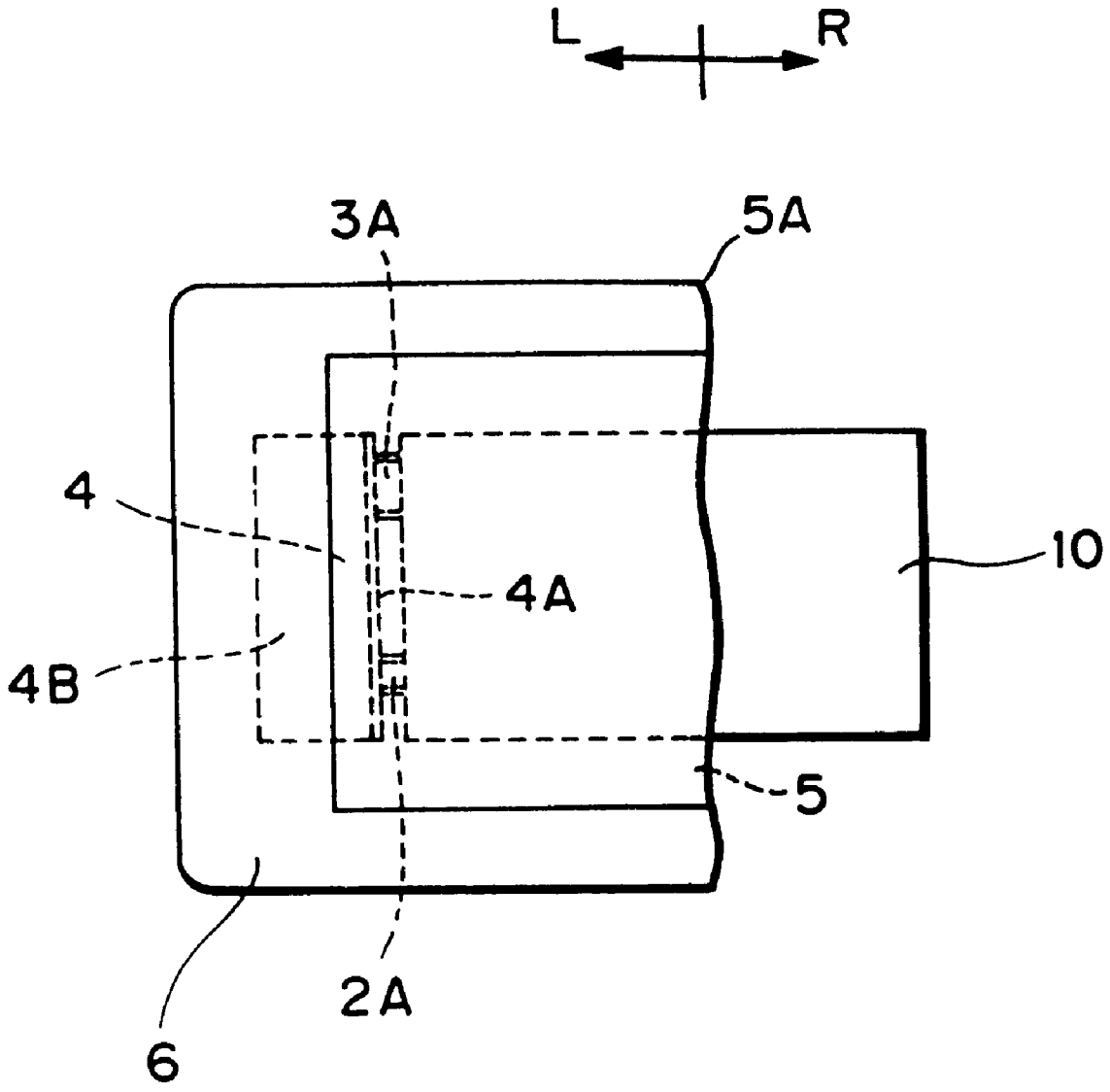
FIG. 4 is a schematic perspective diagram of an exemplified package of ink cartridge for explaining a condition of taking an ink cartridge thereof in accordance with the present invention.
Figure 5A:
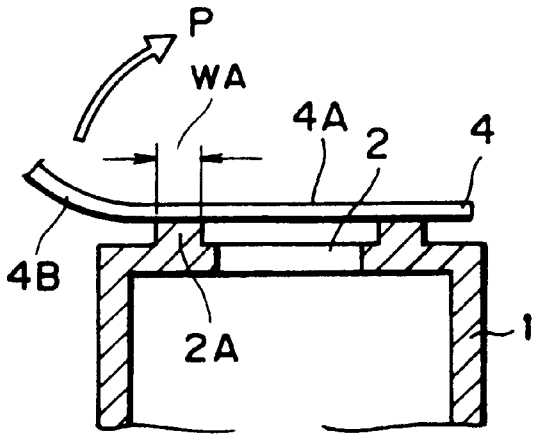
FIG. 5A is a sectional view taken substantially along the lines 1B—1B of FIG. 3A.
Figure 5B:
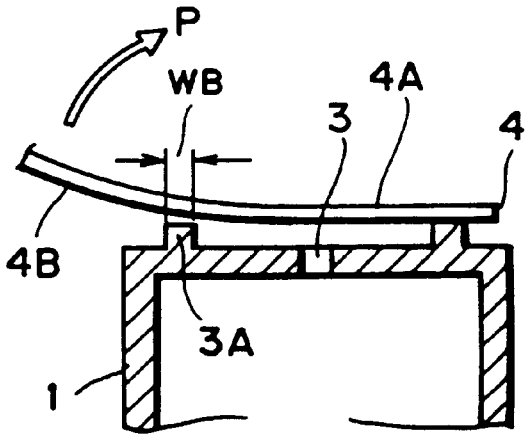
FIG. 5B is a sectional view taken substantially along the lines 3C—3C of FIG. 3A.

FIGS. 4, and 5A–5B are illustrations for explaining the way of sealing off the replaceable ink cartridge 10 constructed as described above.

FIG. 4 illustrates a condition of tearing the package 5A of FIG. 1 from the cutting portion 5A. That is, the package 5A is pulled into two pieces: one having a part of peripheral portion 6 connecting with the edge 4B of the seal member (a part indicated by an arrow L of the figure, hereafter referred as a left part); and the other having a part of peripheral portion 6 without the edge 4B of the seal member 4 (a part indicated by an arrow R of the figure, hereinafter referred as a right part).

FIGS. 5A and 5B indicate that the steps of tearing the seal member from the ink outlet 2 and the air communicating port 3 after the condition shown in FIG. 4. to leave them open.

First of all, as shown in FIG. 4, a bared portion of the ink cartridge 1 and the seal member's edge 4B connecting with the package 5 are pulled out toward opposite directions, resulting that the sealed portion of the seal member 4 is stripped off from the ink outlet 2 and the air communicating port 3.

At this moment, the collar rib 3A of the air communicating port 3 receives a force of the strip movement at first because its external form is larger than that of the collar rib 2A of the ink outlet 2; that is, rib 3A is closer than rib 2A to the end of a seal member 4 where peeling is initiated (compare FIGS. 5A and 5B). Consequently the seal member 4 starts to strip off from the collar rib 3A at first (FIG. 5B). At this moment, however, an external form of the collar rib 2A is smaller than that of the collar rib 3A so that the collar rib 2A does not receive the force of the strip movement (FIG. 5A). Furthermore, the thickness WB of the collar rib 3A is smaller than the thickness WA of the collar rib 2A so that the air communicating port 3 is able to communicate with the atmosphere just after the beginning of the strip movement. On the other hand, it is difficult to make a communication between the ink outlet 2 and the atmosphere just after the beginning of the strip movement because of the collar rib 2A has a larger thickness compared with that of the collar rib 3A.

By the above construction, therefore, the strip movement of the seal member 4 permits an unseal of the air communicating port 3 prior to an unseal of the ink outlet 2.

In the above construction, furthermore, collar ribs 2A and 3A are uniformly formed around the ink outlet 2 and the air communicating port 3, respectively, so as to have a constant thickness. However, it is also possible to keep the relation of $WB \geqq WA$ only for at least each part of these collar ribs, where the stripping force is initially effected.

Figure 6:
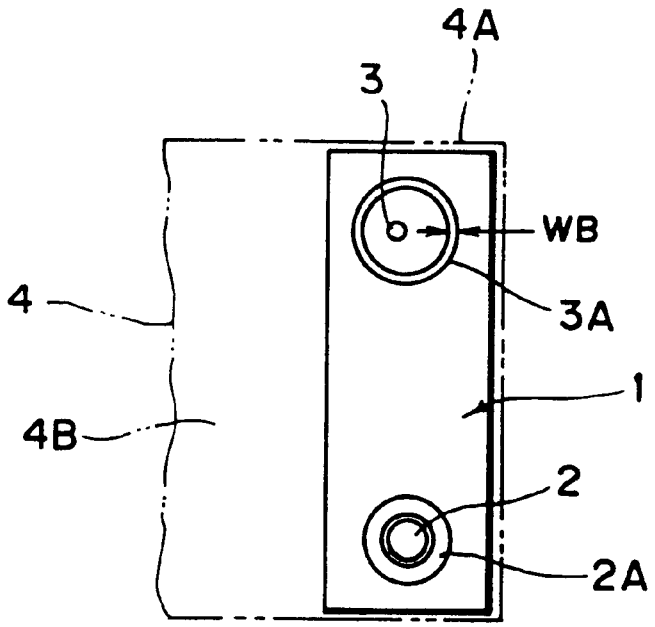
FIG. 6 is a plan view of a sealing surface of a replaceable ink cartridge for explaining another embodiment of a construction of peripheral portions around an ink outlet and an air communicating port of the ink cartridge in accordance with the present invention.

As shown in FIG. 6, furthermore, effects of the present invention can be also obtained by forming the collar rib 3A of the air communicating port 3 as a cylindrical one with a thickness WB satisfying the inequality of $WB<WA$. In addition, it is also possible to tilt a center of the collar rib 3A from a center of the collar rib 2A around the ink outlet 2 to the extended portion 4B of the seal member for communicating the air communicating port 3 with the atmospheric as soon as removing the seal member 4 from the collar rib 3A.

Figure 7:
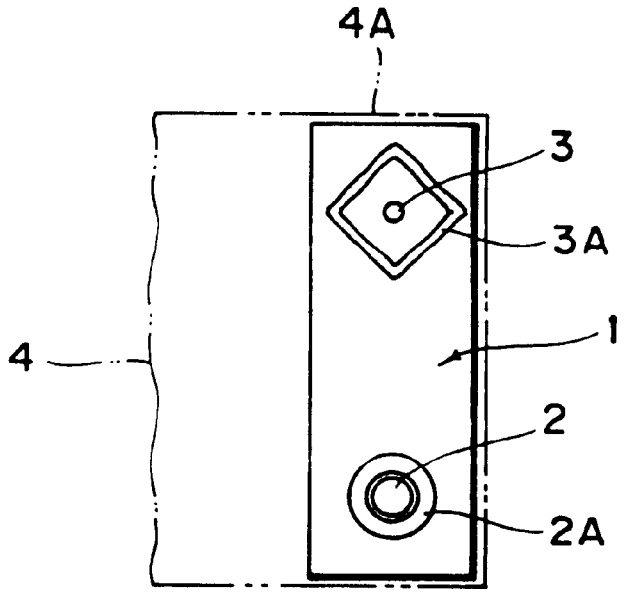
FIG. 7 is a plan view of a sealing surface of a replaceable ink cartridge for explaining another embodiment of a construction of peripheral portions around an ink outlet and an air communicating port of the ink cartridge in accordance with the present invention.

Besides, as shown in FIG. 7, it is possible to construct the collar rib 3A of the air communicating pore 3 so as to form the collar rib 3A as a square tube having a corner being positioned at the side of the seal member's edge 4B. That is, the corner of the square is positioned toward the direction of stripping the seal member for more easily strip movement.

Figure 8:
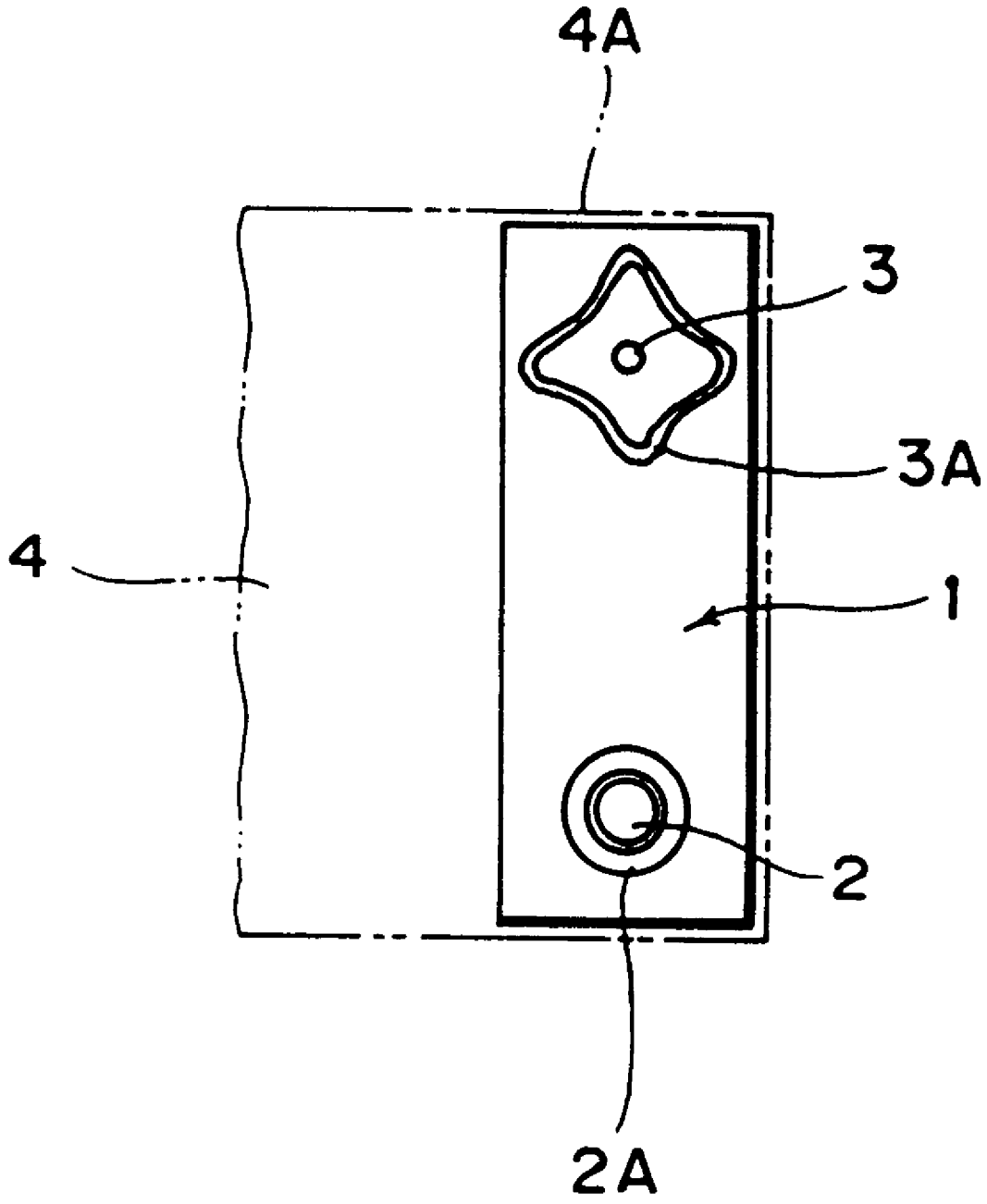
FIG. 8 is a plan view of a sealing surface of a replaceable ink cartridge for explaining another embodiment of a construction of peripheral portions around an ink outlet and an air communicating port of the ink cartridge in accordance with the present invention.

Still furthermore, as shown in FIG. 8, it is possible to make the collar rib 3A in the shape of star-like tube having rounder protruded portions and one of them is positioned at the side of the seal member's edge 4B.

Moreover, in spite of the constructions shown in FIGS. 6, 7, and 8, a thickness of the collar rib 3A formed on each ink cartridge is smaller than that of the collar rib 2A around each ink outlet 2. According to these constructions, the air communicating port 3 can be sealed off at first, prior to the ink outlet 2.

As described in the above embodiment, the collar rib 3A around the air communicating port and the collar rib 2A around the ink outlet can be formed and positioned in any of several possible ways, for example an opening of the collar rib 3A around the air communicating port is larger than that of the collar rib 2A around the ink outlet; a thickness of the collar rib 3A is smaller than that of the collar rib 2A; and at least a part of the peripheral portion of the collar rib 3A is positioned at a front of the collar rib 2A when the seal member 4 is removed off. However, the construction cannot be restricted by the above description but it can be formed and positioned in every ways under the conditions described above.

Second Preferred Embodiment

In the above first preferred embodiment, the peripheral portions of the ink outlet and the air communicating port are constructed so as to open the air communicating port at first in accordance with the strip movement of the seal member. In the second preferred embodiment, on the other hand, another construction for more appropriate propagation of the force of stripping the seal member onto a sealed portion between the seal member and the air communicating port (or the ink outlet) will be described in detail.

Figure 9:
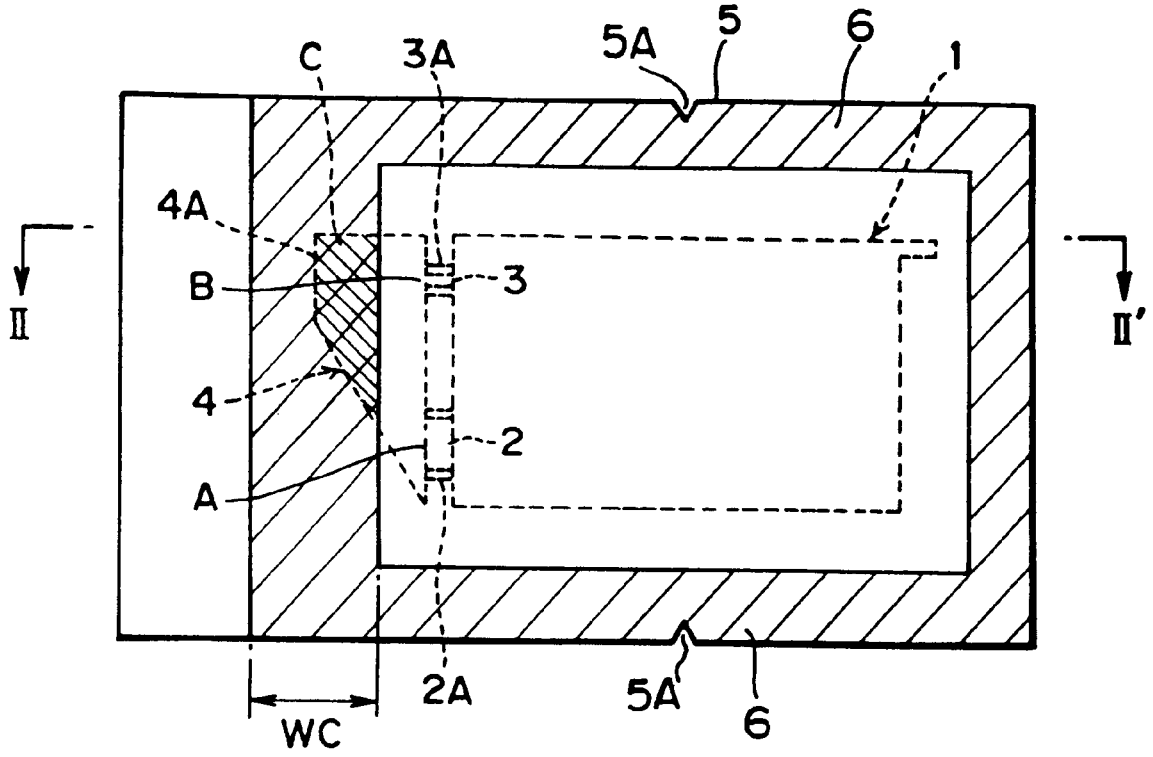
FIG. 9 is a perspective plan diagram of an embodiment of the present invention.
Figure 10:
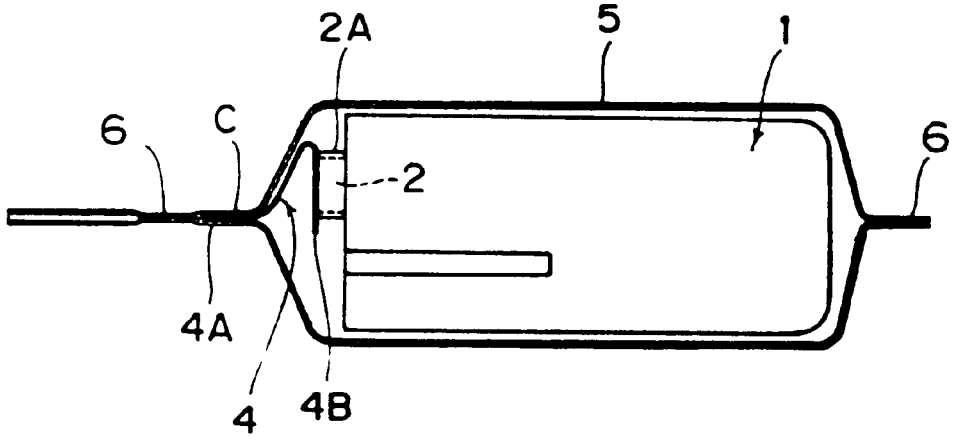
FIG. 10 is a sectional view taken substantially along the lines II-II' of FIG. 9.

FIG. 9 is a schematic diagram for explaining each construction of a replaceable ink cartridge, a package for covering the cartridge, and a seal member for sealing an ink outlet, and an air communicating port of the cartridge in accordance with the present invention. Also, FIG. 10 is a sectional view taken substantially along the lines II-II' of FIG. 9.

In the figures, reference numeral 1 denotes an ink cartridge body (hereinafter, referred as a body), 2 denotes the ink outlet, 3 denotes the air communicating port, 4 denotes the seal member sealing the ink outlet 2 and the air communicating port 3, and 5 denotes the package for packing the whole body 1. The body 1 is provided as a container for storing ink. In this embodiment, as described in later, the body 1 comprises a housing portion for holding a negative-pressure generating member and an ink storage portion for storing ink. The negative-pressure generating member absorbs ink to hold it inside and communicates with the ink outlet 2 and the air communicating port 3.

Figure 11:
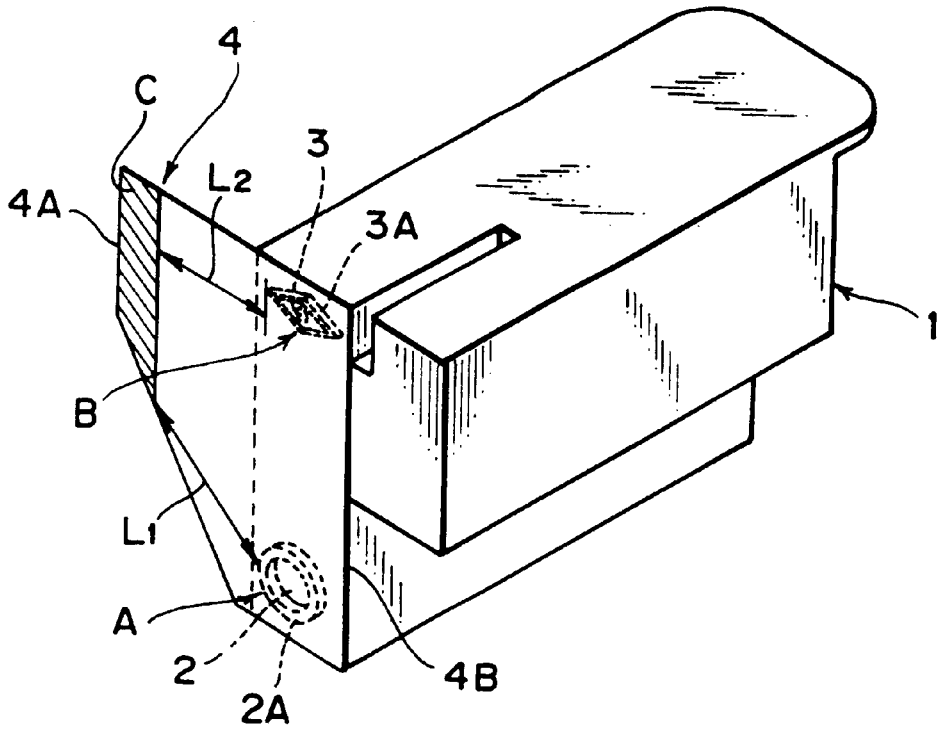
FIG. 11 is a perspective view of a body and a seal member of the replaceable ink cartridge shown in FIG. 9.
Figure 12:
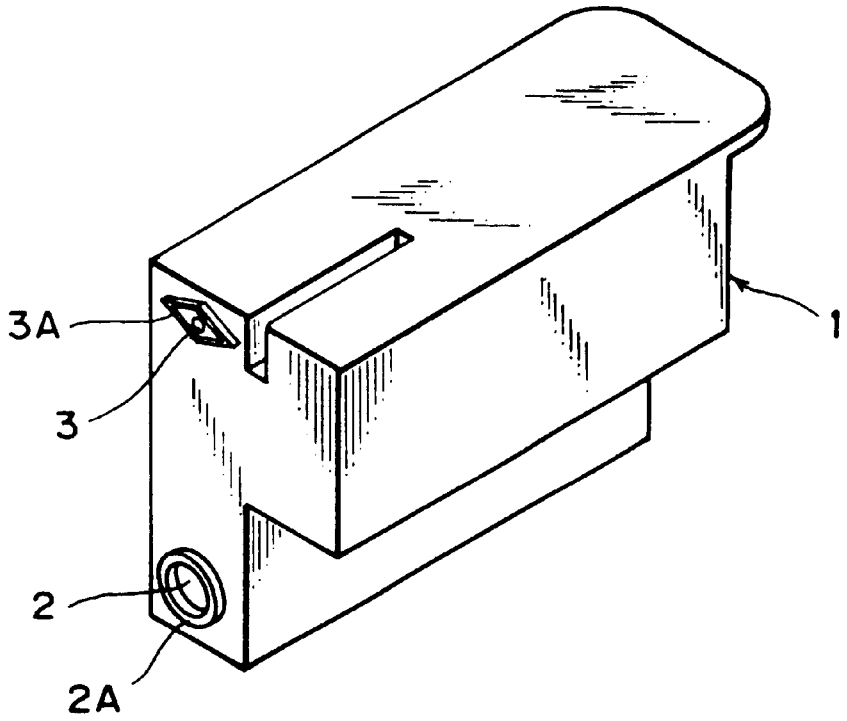
FIG. 12 is a perspective view of a body of the replaceable ink cartridge shown in FIG. 9.

As shown FIGS. 11 and 12, a cylindrical collar rib 2A is formed around an opening of the ink outlet 2, and also a tubular collar rib 3A having a cross section shaped like a parallelogram is formed around an opening of the air communicating port 3. In this embodiment, it is noted that a diameter of the opening of the ink outlet 2 is almost the same size as that of an inner peripheral surface of the collar rib 2A but larger than that of the air communicating port 3. Furthermore, a thickness WA of the collar rib 2A is larger than a thickness WB of the collar rib 3A.

It is preferable that the seal member is made of a flexible barrier material having a sufficient strength with respect to forces to be applied on the seal member, such as a force of pulling the seal member. Therefore, the material is, for example a complex material consisting of a plurality of layers of plastic films or a single layered plastic film. It is also preferable that the material shows the properties of welding with end surfaces of the collar ribs 2A and 3A. The seal member according to this embodiment, as shown in FIG. 11, is in the form of a flat trapezoid having a short upper side 4A and a long under side 4B. The seal member 4 is provided in that its under side 4B is located over the collar ribs 2A and 3A and an adjacent area of the under side 4B is welded with each end surface of these ribs 2A and 3A. Consequently, the ink outlet 2 and the air communicating port 3 are sealed. In concerned with the seal member 4, hereinafter, we define a portion responsible for sealing the ink outlet as a first seal portion A and another portion responsible for sealing the air communicating port 3 as a second seal portion B. It is noted that the first and second seal portions A, B have to only seal the ink outlet 2 and the air communicating port 3 so as to endure expanding pressures of ink and air in the body 1 and to prevent a vaporization of ink in the body 1. Therefore, it is not limited to connect the seal member by welding but also by one of every connecting methods including a squeeze and a bonding. For ensuring the high reliability, it is preferable to connect the body 1 with a contact layer prepared by the same material system as that of the body 1.

The upper side 4A of the seal member 4 is on the side of the second seal portion B nearer than the first seal portion A (i.e., it is on an upper area of FIG. 11). In addition, an area in close proximity to the upper side 4A (i.e., a slanting-lined portion C in FIG. 11) is welded with an inner side of the package 5. Hereinafter, we refer the slanting-lined portion C in the figure as a handling portion.

The package 5 is in the form of a bag for covering the entire body 1 of the ink cartridge. In this embodiment, a peripheral portion 6 of the package 5 is welded so as to form the bag. In this case, the handling portion C of the seal member 4 is also welded in the peripheral portion 6. The package 5 may be connected with the handling portion C of the seal member 4 by the way of contact welding, pressure welding, solvent welding, sticking with an adhesive, or the like. Also, a material of the package 5 may be the same as that of the seal member or one selected from any materials to be used in the field of packaging, such as paper and a plastic sheet. In this embodiment, a welding layer of the seal member 4 and a welding layer of the package 5 are welded together by applying heat with pressure. Under the state that the body 1 is packed in the package 5, as shown in FIG. 10, there is a curved portion between the upper end 4A and the under end 4B of the seal member 4.

Then the process of opening the replaceable ink cartridge of the present embodiment will be explained in the following description.

Figure 13:
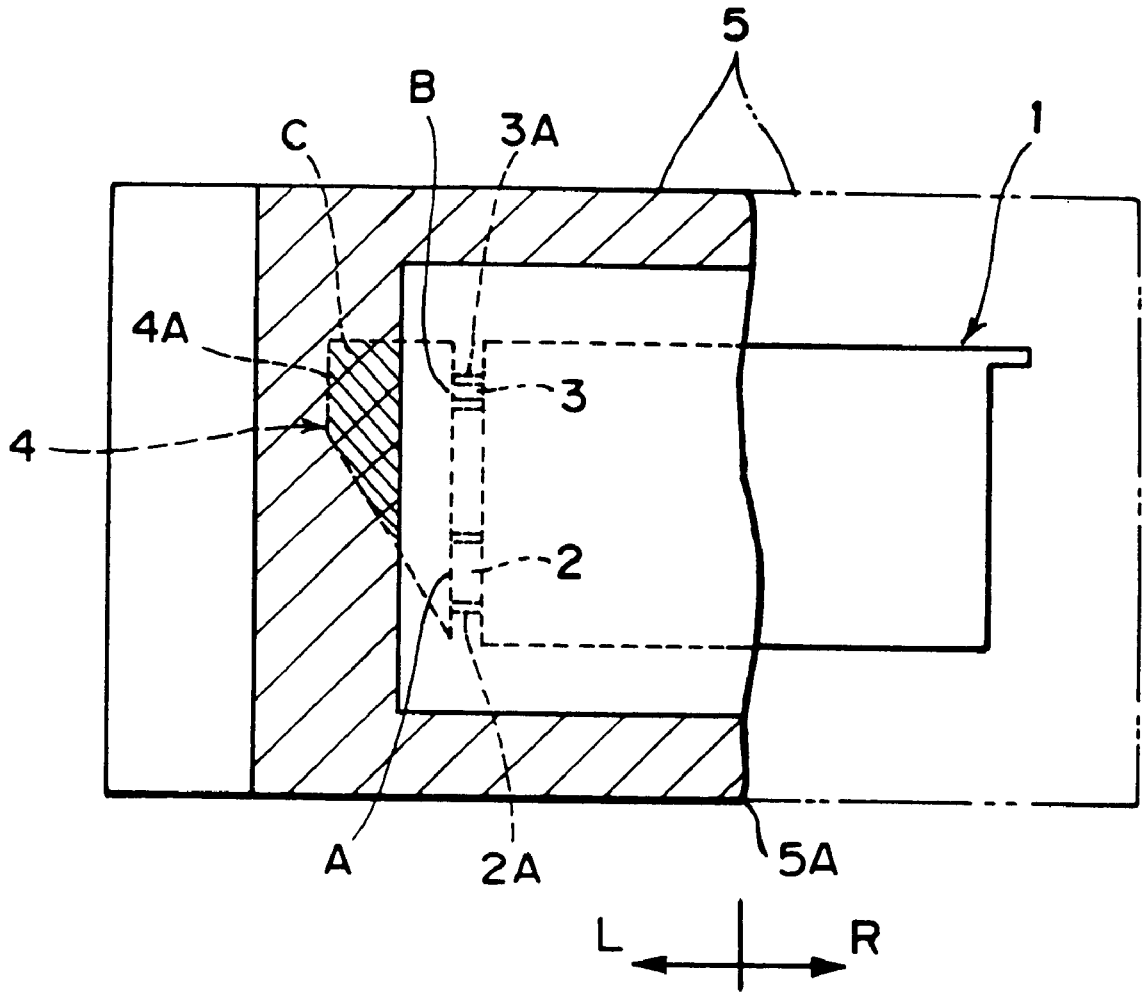
FIG. 13 is a plan view of a partially cut package of the ink cartridge shown in FIG. 9.

FIG. 13 and FIGS. 14A to 14C are schematic diagrams for illustrating the procedure of opening the replaceable ink cartridge. As shown in FIG. 13, the process including the step of cutting the package 5 into two pieces from the cutting portion 5A to remove the part indicated by an arrow R in the figure (i.e., a left half in the figure). That is, the part indicated by an arrow L (i.e., a right half in the figure, which is a part responsible for preventing a scatter of ink) remains while the left half is removed. In the present embodiment, a part of the peripheral portion of the package 5, which is above a cutting line (not shown), is cut down to make a cutting portion 5A to make the cutting more easily and perfectly. However, it is not limited to that cut area. It is also possible to use a perforation along the cutting line. Preferably, a peel tape or the line may be provided along the cutting line on the package 5. In this case, the package can be separated into two parts along the cutting line by pulling the peel tape.

Figure 14A:
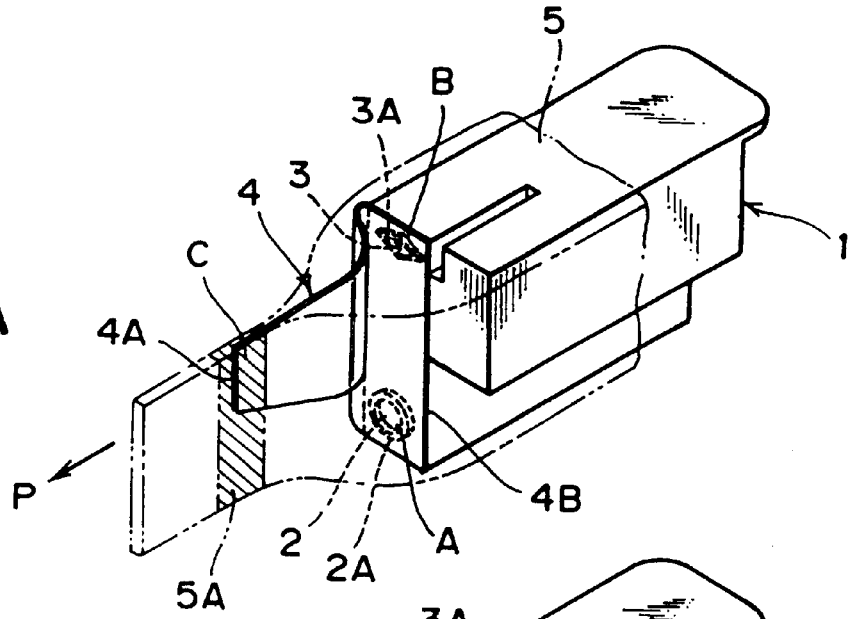
FIG. 14A is a perspective view of a replaceable ink cartridge with a package to explain a step of sealing off the seal member shown in FIG. 9.

FIG. 14A illustrates the package 5 where the right half are removed. In the figure, the remained left half of the package 5 is indicated by a two-dot slash line.

After removing the right half of the package 5, the operator takes an end of the left half of the package with his or her fingers and pulls it toward the side away from the body 1 (e.g., a direction of an arrow P in FIG. 14A). A force of the pulling operation is applied on the handling portion C of the seal member 4, resulting that the seal member is stripped off from the collar ribs 2A and 3A, following with a separation of the left half of the package 5 from the body 1, as shown in FIG. 14B and FIG. 14C.

At this time, a force (a peel force) in the direction of an arrow P to be applied to the handling portion C tends to propagate toward the second seal portion B rather than the first seal portion A. That is, as shown in FIG. 11, the length L2 between the handling portion C and the second seal portion B is shorter than the length L1 between the handling portion C and the first seal portion A. In this embodiment, it is defined that the shortest length L2 between the handling portion C and the second seal portion B is shorter than the shortest length L1 between the handling portion C and the first seal portion A in consideration of the facts that the handling portion C is elongated along the upper end portion 4A and each operator picks at any positions and pulls the handling portion C toward any directions as his or her pleases.

Figure 14B:
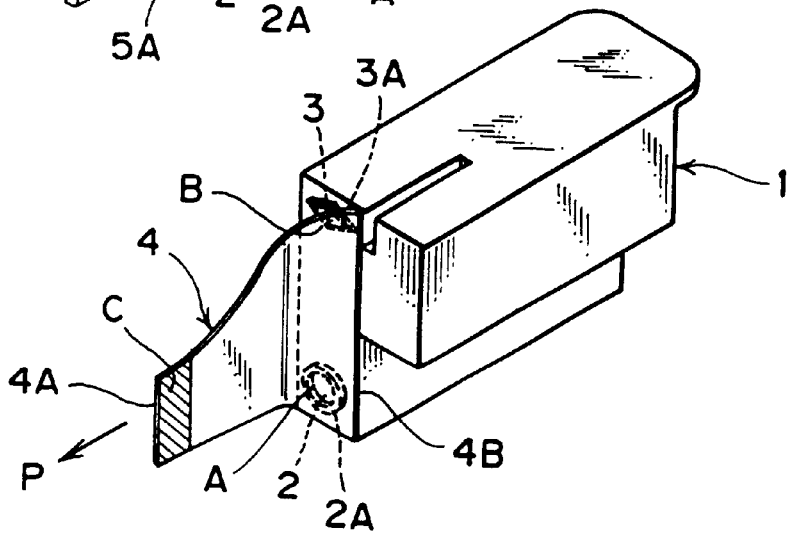
FIG. 14B is a perspective view of a replaceable ink cartridge with a package to explain a step of sealing off the seal member shown in FIG. 9.

Therefore, the second seal portion B is peeled off from the collar rib 3A at first before the first seal portion A is peeled off from the collar rib 2A (FIG. 14B). In short, the air communicating port 3 can be opened before the ink outlet 2, resulting that it prevents a scattering of ink to be occurred when the ink outlet 2 is opened at first.

Figure 14C:
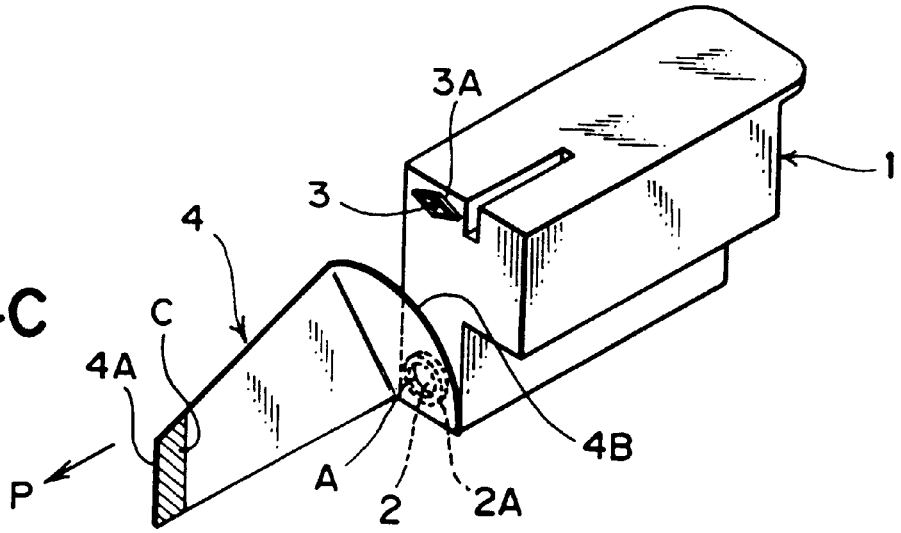
FIG. 14C is a perspective view of a replaceable ink cartridge with a package to explain a step of sealing off the seal member shown in FIG. 9.
Figure 15:
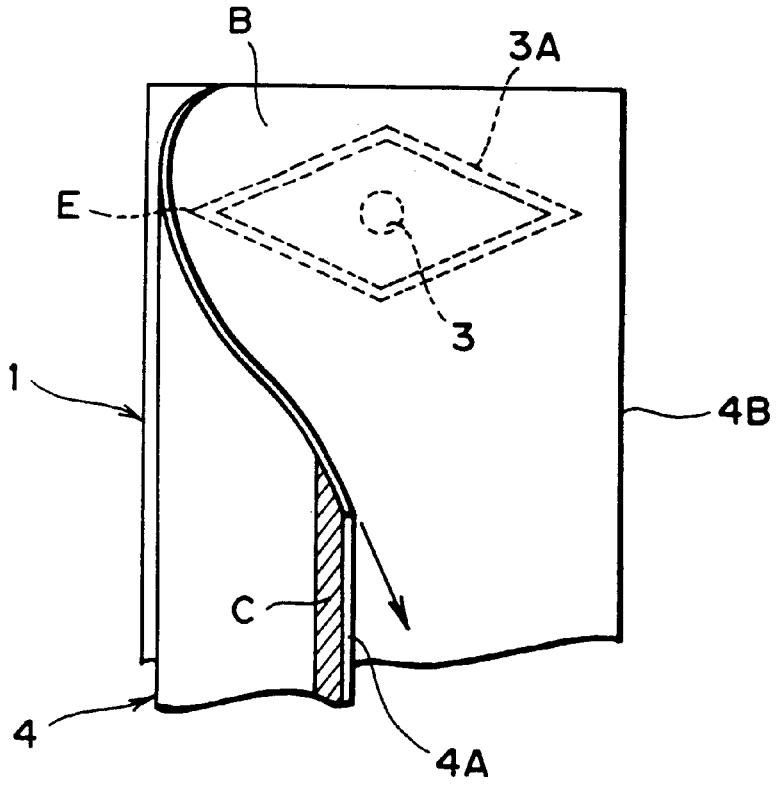
FIG. 15 is an enlarged side view of the air communicating port of the replaceable ink cartridge shown in FIG. 9.
Figure 16A:
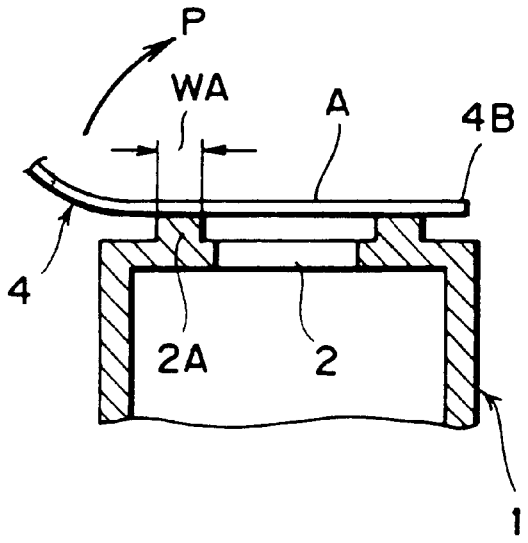
FIG. 16A is a sectional view of the air communicating port shown in FIG. 15 for explaining the step of sealing off.
Figure 16B:
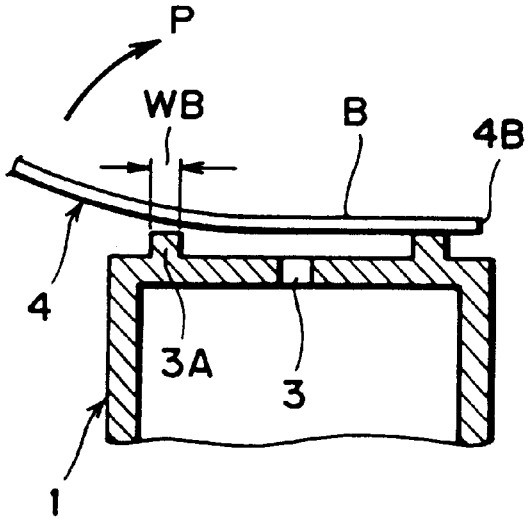
FIG. 16B is a sectional view of the air communicating port shown in FIG. 15 for explaining the step of sealing off.

FIGS. 14A–C, FIG. 15, and FIG. 16B illustrate the beginning of sealing off the air communicating port 3, while FIG. 14C and FIG. 16A illustrate the beginning of sealing off the ink outlet 2. In these figures, the left half of the package 5 is omitted to illustrate but it covers the ink outlet 2 and the air communicating port 3 during the period of pulling out the seal member 4. Therefore, it is able to receive leaked ink to keep user's hands and clothes clean.

In this embodiment, furthermore, the collar rib 3A is formed as a cylindrical projection with a cross section in the shape of a parallelogram in a plane view. An acute angle (i.e., an angle portion E in FIG. 15) of the parallelogram is corresponded to a start position to peel the second seal portion B. Thus the angle portion E receives a concentrated stress of the peel force being applied on the handling portion C of the seal member 4 for peeling the second seal portion B more easily. Therefore, it make sure that the air communicating port 3 is opened at first. In addition, a stress of the peel force may be concentrated on the an peeling start area of the second seal portion B by forming a side extending along the direction of peeling the second seal portion on a peripheral of a welded face between the opening of the air communicating port 3 and the second seal portion B. In this embodiment, furthermore, a thickness WB of the collar rib 3B is smaller than a thickness WA of the collar rib 2A, so that a strength of a welded face between the collar rib 3A and the second seal portion B is frailer than that of a welded face between the collar rib 2A and the first seal portion A. Therefore, it make more sure that the air communicating port 3 is opened at first. These matters were already described in the first embodiment in detail.

The seal member 4 of the present embodiment has a trapezoidal shaped flat surface. A short upper side 4A of the trapezoid is positioned in the welded portion 6 of the of the package 5. In the FIG. 9, a width of the welded portion 6 is indicated as WC. The area neighboring the upper side is provided as the handling portion C, and thus the step of binding the seal member 4 with the package can be performed during the process of welding a package material into a bag-like form without interrupting the operator's manipulation.

As shown in FIG. 11, a length L1 from the collar rib 2A to the handling portion C is longer than a length L2 from the collar rib 3A to the handling portion C (i.e., L1>L2). The inequality of L1>L2 is realized by a relative positions of the ink outlet 2, the air communicating port 3, and the connected site between the seal member 4 and the package 5. Therefore, the seal member 4 and the package 5 do not limited in the shape or the like illustrated in the figures but it takes every shapes or the like within the limit of satisfying the above inequality. That is, it only requires that the handling portion C corresponding to the joint area between the seal member 4 and the package 5 is on the air communicating port's side rather than the ink outlet's side. Furthermore, it is also possible to modify or change the material, the shape, or the like of the portions between the handling portion C and the first or second handling portion under the condition that the peel force to be applied on the handling portion C of the seal member 4 is easily transmitted to the second seal portion B rather than the first seal portion A.

Figure 17:
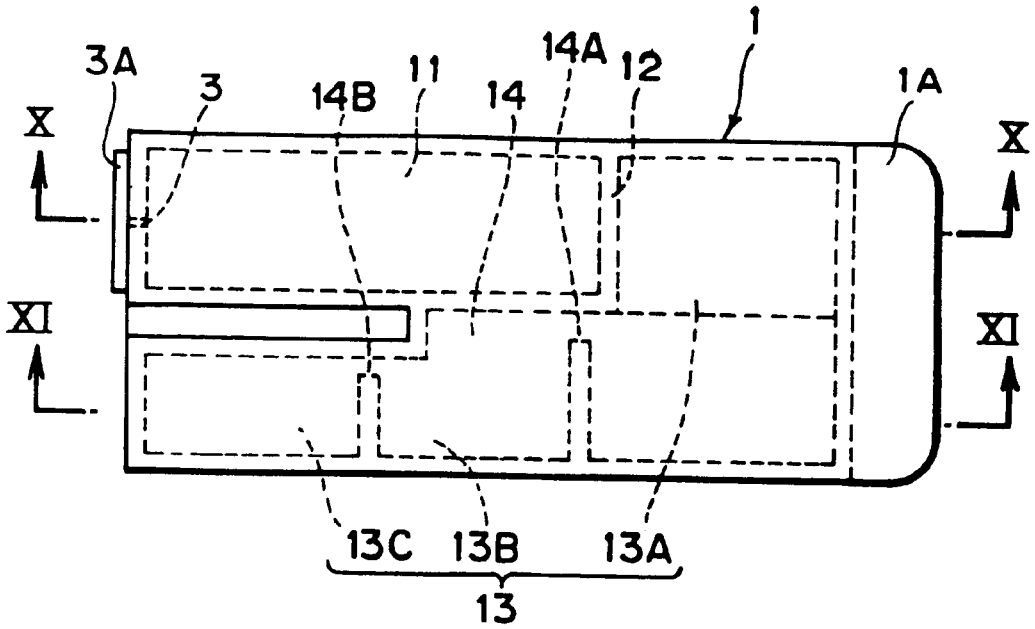
FIG. 17 is an enlarged side view of the ink cartridge body shown in FIG. 9.
Figure 19:
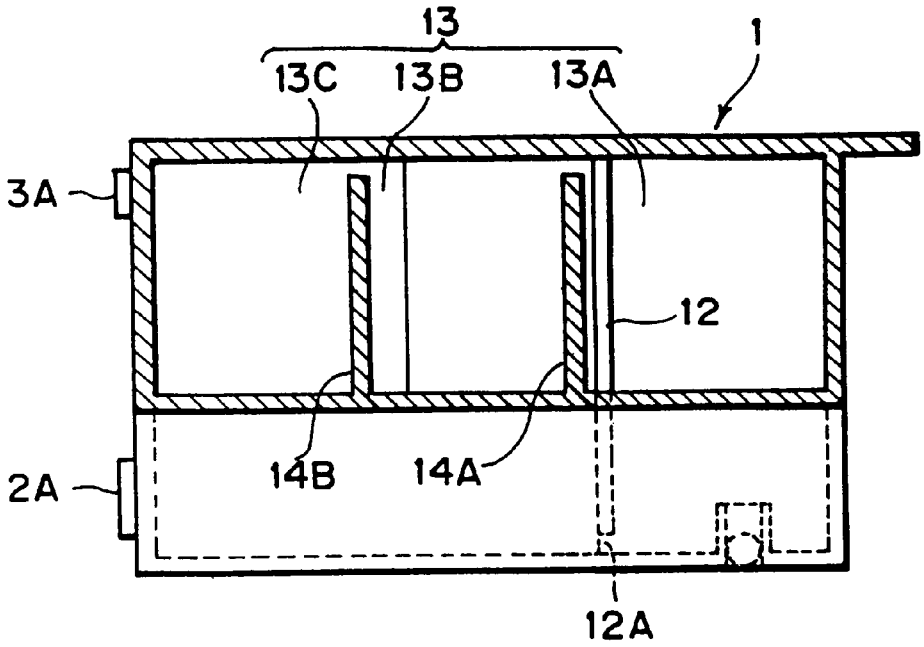
FIG. 19 is a sectional view taken substantially along the lines XI—XI of FIG. 17.

FIG. 17 and FIG. 19 illustrate an inner structure of the ink jet cartridge's body 1 in accordance with the present invention.

The body 1 has an ink outlet 2 to be connected with an ink jet recording head and an air communicating port 3 formed above the ink outlet 2. Also, the body comprises: a holding section 11 for holding a negative-pressure generating member 20 by which ink is absorbed and held; and an ink storage section 13 communicating with the holding section 11 by means of a space under the rib 12. Furthermore, the ink storage section 13 comprises a first ink storage portion 13A, a second ink storage portion 13B communicated with the first portion 13A through a communicating path 14A, and a third ink storage portion 13C communicated with the second portion 13B through a communicating path 14B. Therefore the ink storage section 13 has a comparatively large capacity for storing ink, so that the body 1 can be preferably used for storing a black ink to be more frequently consumed than other color inks in the process of forming a color image by the recording apparatus. It is noted that a half part of an inner bottom's surface of the ink storage portion 13A on the side of line XI—XI in FIG. 17 and inner bottom's surfaces of the ink storage portions 13B and 13C are located over the level of the ink outlet 2 at a predetermined distance. In the present embodiment, it is also noted that a material having a porous structure, such as urethane foam, makes up the negative-pressure generating member 20. In the figure, reference numeral denotes a pick-up portion for picking up in user's fingers to detach the cartridge's body 1 from the recording head.

In the holding section 11 for holding the negative-pressure generating member, a gradation of ink can be observed. For smoothly supplying the ink to the ink jet recording head, that is, a large amount of the ink is concentrated at the ink outlet's side while the ink cannot be observed at the side of the air communicating port. For this reason, it is preferable to open the air communicating port 3 at first. When the ink outlet 2 is sealed off at first, on the other hand, there tends to be a scattering of ink from the ink outlet 2 to the outside. In the case that an inner pressure of the body 1 tightly closed by the seal member is increased by a change in environmental conditions such as temperature and atmospheric pressure, a sudden forcible gush of ink can be suppressed by recovering the inner pressure of the body 1 to the level of atmospheric pressure by sealing off the air communicating port 3 prior to open the ink outlet 2, in which an opening area of the air communicating port 3 is smaller than that of the ink outlet 2.

Figure 18:
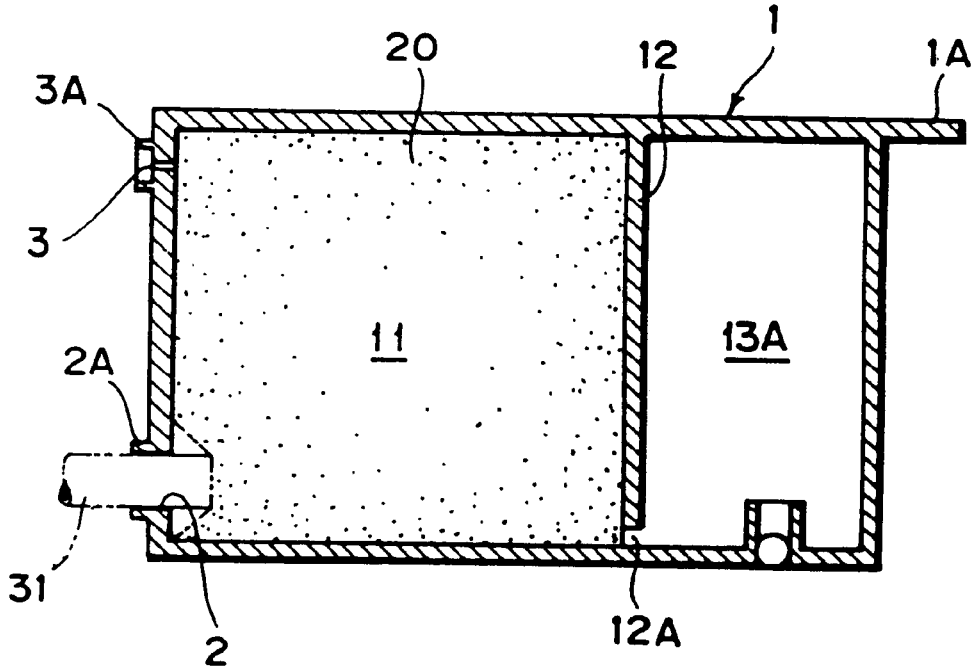
FIG. 18 is a sectional view taken substantially along the lines X—X of FIG. 17.

At the time of installing the ink jet cartridge's body 1 in an ink jet recording apparatus, first of all, an ink inlet tube 31 of the ink jet recording head is inserted into the ink outlet 2 of the body 1 to make a press-contact between the ink inlet tube 31 and the negative-pressure generating member 20, as shown in FIG. 18. In general, an opening of the ink inlet tube 31 may have a filter (not shown in the figure) through which ink is passed in order to separate the fluid from suspended particulate matter. Then the ink jet recording apparatus is switched on to perform an image formation, in which an ejection of ink from each orifice of the ink jet recording head leads to generate a force to absorb ink in the holding section 11. The absorbing force draws the ink into the negative-pressure generating member 11 from the ink storage section 13 through a gap portion 12A under a rib 12. After passing through the negative-pressure generating member 11, the passed ink is further introduced into the ink inlet tube 31 and supplied to the ink jet recording head. Consequently, an inner pressure of the body 13 where all of the openings except the gap 12A are closed is decreased, resulting that a pressure difference between the ink storage section 13 and the negative-pressure generating member holding section 11 is generated. When the recording movement is not lasted, a supply of ink is also continued with an increase of the above pressure difference. However, the ink storage section 13 receives the flesh air passing through the negative-pressure generating member 20 and the gap portion 12A under the rib 12 because the negative-pressure holding section 11 communicates with the atmosphere through the air communicating port 11. Therefore, it results in a cancellation of the above difference between the ink storage section 13 and the negative-pressure generating member 11. During the recording movement, the above steps can be repeated to supply ink, more smoothly. In this embodiment, furthermore, a whole amount of ink in the ink storage section 13 can be used up, except that an extremely small amount of ink adheres on each wall surface of first and second ink storage portions 13A and 13B. Therefore, the high efficiency of using ink can be attained. During the state of stopping the recording operation, the negative-pressure generating member 20 exerts a force of capillary phenomenon or the like, so that a leakage of ink from the ink jet recording head can be prevented.

Figure 20:
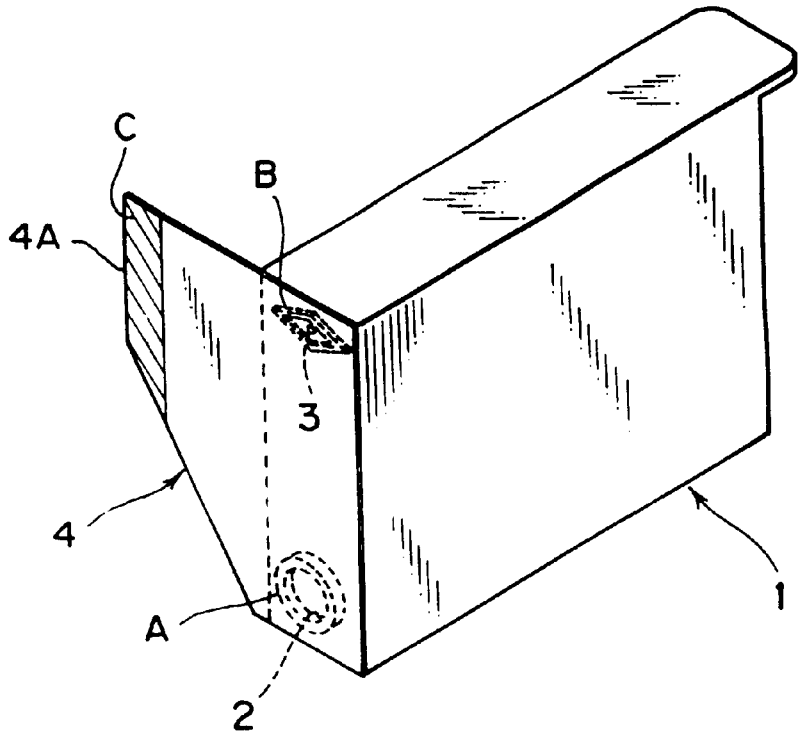
FIG. 20 is a perspective view of an replaceable ink cartridge body as another embodiment of the present invention.
Figure 21:
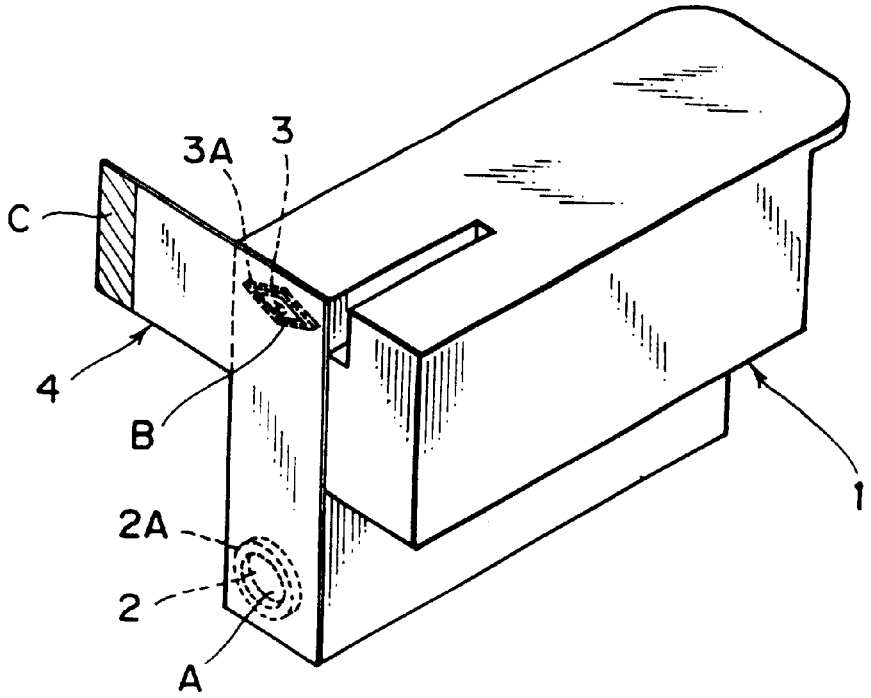
FIG. 21 is a perspective view of a seal member and a replaceable ink cartridge as another embodiment of the present invention.

According to the present embodiment, the seal member 4 may be effectively applied on the ink cartridge that have the same appearance as of the first embodiment as shown in FIG. 20.

A configuration of the seal member 4 may be in the shape of character "L" in a plane view thereof. In this case, therefore, the seal member 4 has a first side area corresponding to a vertical side of the "L" and a second side area corresponding to a horizontal side thereof. As shown in FIG. 20, the first seal portion A is defined on a top side of the first side area; the second seal portion B is defined on a bottom side of the first side area, where a cross point of two side areas; and the handling portion C to be welded with the package 5 is formed at an end of the second side area, far from the first side area. Therefore, a peel force being applied on the handling portion C is transmitted to the second seal portion B rather than the first one A, so that the air communicating port can be opened at first prior to open the ink outlet 2.

Figure 22:
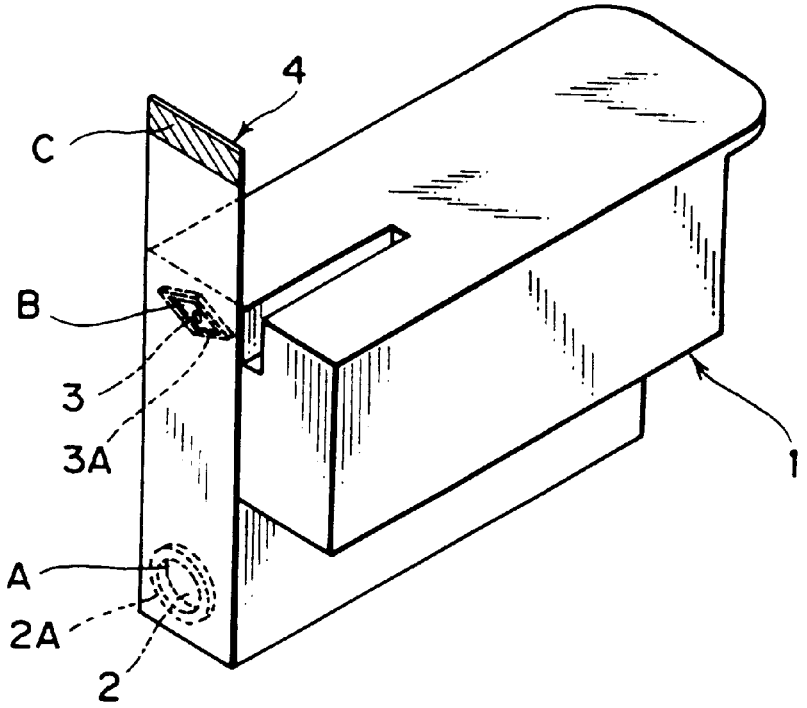
FIG. 22 is a perspective view of a seal member and a replaceable ink cartridge as another embodiment of the present invention.

Another shape of the seal member 4 is shown in FIG. 22. In this figure, the seal member 4 is in the shape of a linear belt with an end portion provided as a handling portion C. First and second seal portions A and B are formed in line on the seal member 4 in that the second seal portion B is on the side of the handling portion C and the first seal portion A is on the opposite side thereof. Therefore, the seal member 4 is removed from the second seal portion B at first by a peel force being applied on the handling portion C and then it is removed from the first seal member A.

A shape of the seal member 4 may be optionally determined on condition that the shape thereof is for easily transmitting a peel force applied on the handling portion C to the second seal portion B rather than the first seal portion A.

In the above embodiments, furthermore, the package 5 is not indispensable because the seal member 4 only requires a means for applying a peel force on the handling portion C by the user.

In the case of the above embodiments, therefore, the handling portion C is like a tongue protruded outwardly from the ink outlet 2 and the air communicating port 3 formed on a surface of the body 1, so that it is an inevitable consequence that only the handling portion C is specified as the place where a peel force is applied effectively. In the case of using the package 5, however, it is no need to connect the package 5 and the handling portion C.

In the case of opening the air communicating port 3 prior to open the ink outlet 2, it is good to consider peeling resistance of the first and second seal portions A, B (i.e., abilities thereof to resist a peel force along the peeling direction) in addition to consider the properties of easily transmitting a peel force applied on the handling portion C to the second seal portion B rather than the first seal portion A. That is, the air communicating port 3 can be opened prior to open the ink outlet 2 by peeling the second seal portion B prior to peel the first seal portion A under the condition that a force standing up to the peeling between an opening of the air communicating port 3 and the second seal portion B is smaller than that of between an opening of the ink outlet 2 and the first seal portion A. It is noted that this kind of peeling operation can be occurred in spite that these peeling portions receive almost the same degree of the peel force at the same time.

For making the condition that the peeling resistance of between an opening of the air communicating port 3 and the second seal portion B is smaller than that of between an opening of the ink outlet 2 and the first seal portion A, for example, as mentioned above, a thickness WB of the collar rib 3A may be limited so as to be smaller than a thickness WA of the collar rib 2A (see FIGS. 16A and 16B), or a stress of the peel force may be concentrated on an edge portion E (see FIG. 15) corresponding to a position of starting the peeling operation in the second seal portion B.

Figure 23:
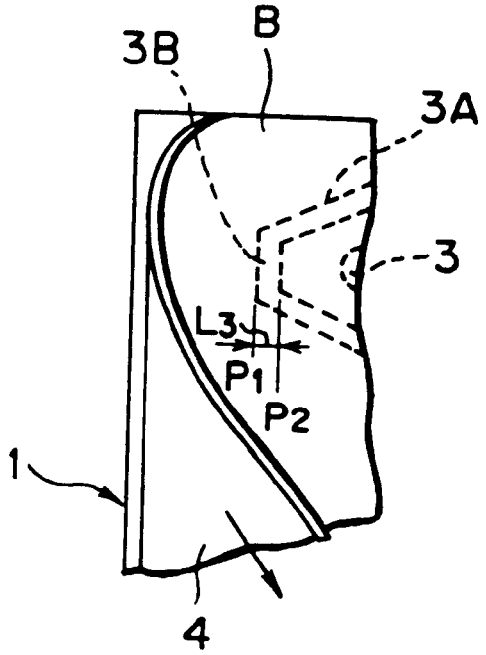
FIG. 23 is a perspective plan diagram of a main part of another embodiment of the present invention.

FIG. 23 is an enlarged partial diagrammatic view of an exemplified configuration of a sealed area formed between a second seal portion B of a seal member 4 and an opening of an air communicating port 3. (The first seal portion A and second seal portion B discussed below are shown in FIG. 22, for example.) In this embodiment, a portion of the collar rib 3A (the left portion thereof in FIG. 23) corresponding to the starting position P1 of peeling operation comprises a side portion 3B being elongated in the direction (i.e., a vertical direction in FIG. 23) perpendicular to the direction of peeling the seal member 4. Therefore, a peel resistance at the peel-starting position P1 of the second seal portion B becomes greater than a peel resistance at the position P2 for opening the air communicating port 3, resulting that a careless peel of the seal member 4 can be perfectly prevented during the process of handling the ink cartridge. As a peel resistance of the second seal portion B at the peel starting position P1 is smaller than that of the first seal portion A at the peel starting position P2, furthermore, it is possible to open the air communicating port 3 prior to open the ink outlet 2 by sealing off the second seal portion B at the peel-starting position P1 at first in spite that almost the same degrees of peel forces are applied on the first and second seal portions A, B at the peel-starting positions P1, P2, respectively.

Figure 24:
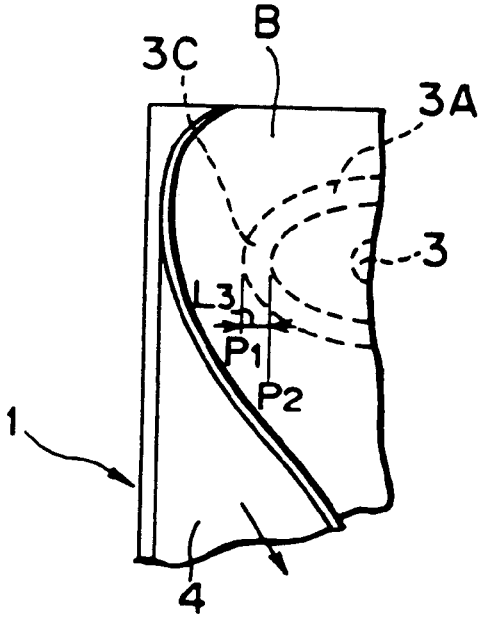
FIG. 24 is a perspective plan diagram of a main part of another embodiment of the present invention.

FIG. 24 is an enlarged partial diagrammatic view of an exemplified configuration of a sealed area formed between a second seal portion B of a seal member 4 and an opening of an air communicating port 3. In this embodiment, a portion of the color rib 3A corresponding to the starting position P1 of peeling operation is formed as a curved portion 3C to prevent a careless peel of the seal member 4 at an area with length L defined as a distance between a peel-starting position P1 and a opening-starting position P2. In this embodiment, the maximum of the peel resistance at the area with length L3 may be smaller than that the peel resistance at the peel-starting position of the first seal portion A.

As described above, furthermore, in the second embodiment a configuration or the like of the rib 3A of the air communicating port 3 is different from that of the rib 2A of the ink outlet 2. As discussed above, providing a collar rib with an enlongated or curved portion perpendicular to the peel direction results in the first seal portion A and the second seal portion B having different peel resistances. In the present embodiment, therefore, there is no need to make these ribs differently, because of their configurations. That is, a distance between the handling portion C and the first seal portion A differs from a distance between the handling portion C and the second seal portion B, so that in this embodiment the seal member may easily be peeled off the air communicating port 3 first.

Figure 25:
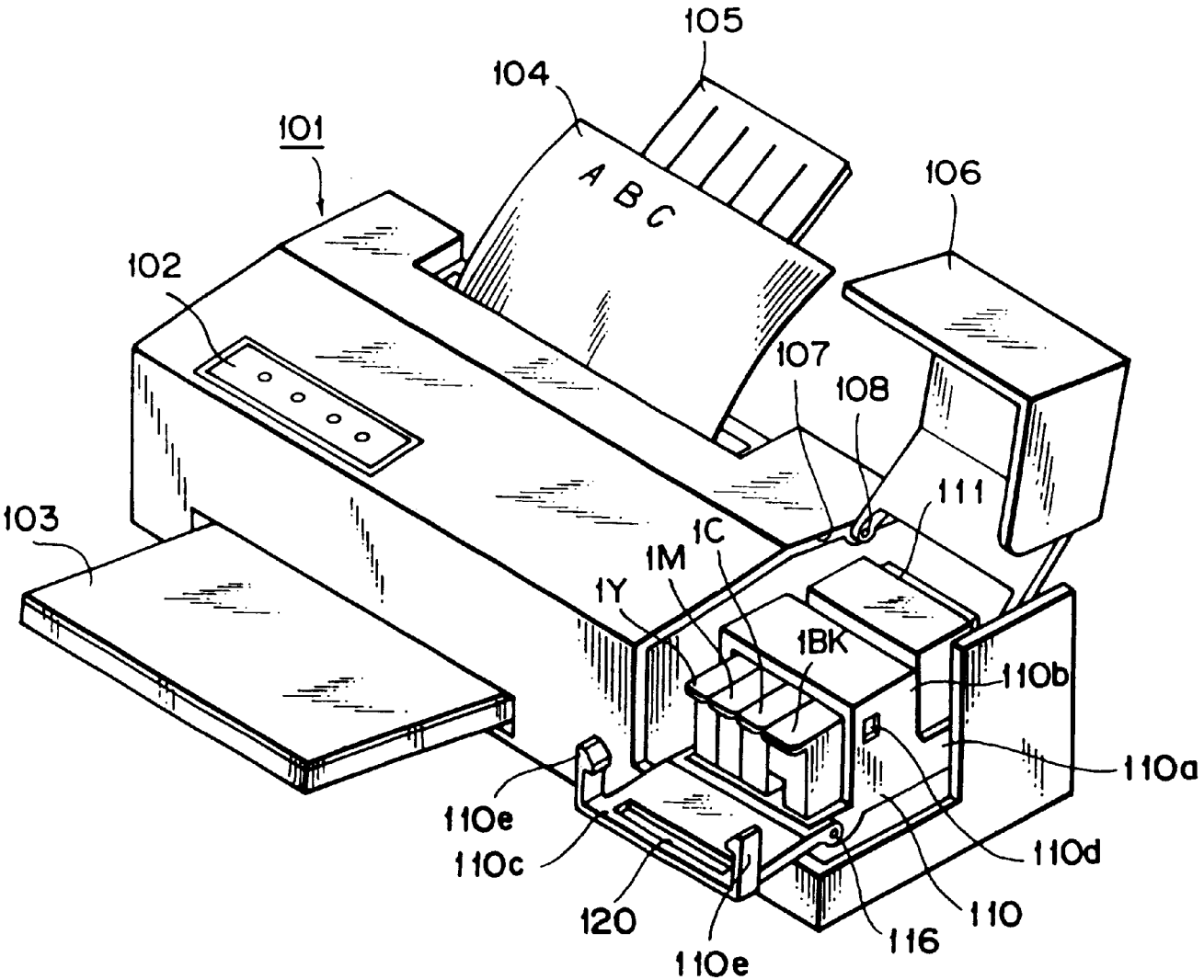
FIG. 25 is a perspective view of an ink jet recording apparatus having a replaceable ink cartridge in accordance with the present invention.

The ink jet cartridge as described above can be installed in a recording apparatus as shown in FIG. 25 to perform a recording of images.

FIG. 25 is a perspective view of an ink jet recording apparatus having a replaceable ink cartridge in accordance with the present invention.

In FIG. 25, reference numeral 101 denotes a printer, 102 denotes an operation panel portion provided on a front side of a housing's top of the printer, 103 denotes a paper-feed cassette placed in an opening formed on a front face of the housing, 104 denotes a sheet of paper (i.e., a recording medium) moved from the paper-feed cassette 103, 105 denotes an expelled paper tray to receive a sheet of paper thrown out from the housing after passing through a paper-feed path in the printer 101, and 106 denotes a body cover in the shape of character "L" in a cross section thereof. The body cover 106 is responsible for covering an opening 107 formed on a right front of the above housing. As shown in the figure, the body cover 106 is jointed with opposite inner sides of the opening 107 by means of a pair of hinges that allow the pivoting of the body cover 106. In the housing, furthermore, a carriage 110 is mounted on a guide or the like (not shown) so as to move back and forth in the direction along a width of the paper passing through the paper-feed path (i.e., the longitudinal direction of the guide or the like).

In this embodiment, the carriage 110 is constituted by a horizontal stage 110*a* being placed in a horizontal position by the guide or the like; an opening (not shown) formed on the stage 110*a* and located in proximity to the guide, in which ink jet recording heads are installed; a cartridge garage 110*b* for accommodating ink cartridges 1Y, 1M, 1C, and 1Bk which are placed on the stage 110*a* in the front area of the opening; a cartridge holder 110*c* for holding these ink cartridges to prevent their dislocations.

The above stage 110*a* has a rear end portion to be slideably supported by the above guide and a front end portion to be placed on a guide plate (not shown) by its hidden side. The guide plate may be of having a mechanism as a paper-hold member for preventing a rise of a sheet of paper to the surface in the paper-feed path or of having another mechanism of lifting one side of the stage with respect to the guide in accordance with a thickness of the paper.

The ink jet recording head (not shown) is installed in the opening of the above stage 110*a* in a manner that ink-ejection orifices of the head are faced in the downward direction.

The above cartridge garage 110*b* comprises a through hole formed therethrough in the front and behind direction and hollows 110*d* for receiving projections (i.e., hooks) 110*e* of the cartridge holder 110*c* on opposite outside portions, respectively.

The front end portion of the stage 110*a* is jointed with the cartridge holder 110*c* by means of a pair of hinges 116 that allow the pivoting of the 110*c*. A distance between the front of the garage 110*b* and the hinge 116 is determined with a consideration of the dimensions or the like of each portion of the ink cartridges 1Y, 1M, 1C, and 1Bk to be protruded from the position of the front of the garage 110*b* at the time of these cartridges are installed.

By the way, the cartridge holder 110*c* is shaped like a square plate and comprises a pair of hooks 110*e* to be engaged in holes 110*d* formed on the above garage 110C at the time of closing the holder 110*c*. As shown in the figure, each hook is provided on an upper edge of the holder 110*c*, which is at the opposite position of the hinged portion at the bottom.

The cartridge holder 110*c* further comprises a slit 120 on a plated surface thereof for firmly attaching to grip portions of the above ink cartridges 1Y, 1M, 1C, and 1Bk. The slit 120 is formed so as to satisfy appropriate conditions (i.e., position, dimensions, shape, and the like) corresponding to the above grip portions.

The present invention has been described in detail with respect to preferred embodiments, and it will now be that changes and modifications may be made without departing from the invention, therefore, in the appended claims to cover all such changes and modifications as fall within the true spirit of the invention.

What is claimed is:

1. A replaceable ink cartridge having an ink supply port and an air communicating port which are formed on a casing, in which a peripheral portion around said ink supply port and a peripheral portion around said air communicating port are sealed by tight contact with one seal member which is removable by peeling off, wherein, a structure of said peripheral portion around said ink supply port and a structure of said peripheral portion around said air communicating port are provided so that said air communicating port is opened prior to opening of said ink supply port when removing said seal member by peeling off said one seal member, a peeling off force of said one seal member acting on both of said peripheral portion around said air communicating port and said peripheral portion around said ink supply port, said structures being formed of a generally circular rib which surrounds said ink supply port and said air communicating port, respectively, and an outer diameter of said generally circular rib surrounding said air communicating port is larger than an outer diameter of said generally circular rib surrounding said ink supply port.

2. A replaceable ink cartridge according to claim 1, wherein a direction of peeling said seal member is regulated via an extension of said peeling member which extends from positions of said structures surrounding said ink supply port and said air communicating port, respectively.

3. A replaceable ink cartridge according to claim 2, wherein, at least a portion of said extension of said seal member is bonded with a packaging member which wraps said casing, and upon opening of said packaging member, said extension, together with said packaging member, is regulated to a limited peeling direction.

4. A replaceable ink cartridge having an ink, supply port and an air communicating port which are formed on a casing, in which a peripheral portion around said ink supply port and a peripheral portion around said air communicating port are sealed by tight contact with one seal member which is removable by peeling off, wherein, a structure of said peripheral portion around said ink supply port and a structure of said peripheral portion around said air communicating port are provided so that said air communicating port is opened prior to opening of said ink supply port when removing said seal member by peeling off said one seal member, a peeling off force of said one seal member acting on both of said peripheral portion around said air communicating port and said peripheral portion around said ink supply port, said structures being formed of a generally circular rib which surrounds said ink supply port and said air communicating port, respectively, and an inner diameter of said generally circular rib surrounding said air communicating port is larger than an inner diameter of said generally circular rib surrounding said ink supply port.

5. A replaceable ink cartridge according to claim 4, wherein a direction of peeling said seal member is regulated via an extension of said seal member which extends from positions of said structures surrounding said ink supply port and said air communicating port, respectively.

6. A replaceable ink cartridge according to claim 5, wherein, at least a portion of said extension of said seal member is bonded with a packaging member which wraps said casing, and upon opening of said packaging member, said extension, together with said packaging member, is regulated to a limited peeling direction.

7. A replaceable ink cartridge having an ink supply port and an air communicating port which are formed on a casing, in which a peripheral portion around said ink supply port and a peripheral portion around said air communicating port are sealed by tight contact with one seal member which is removable by peeling off, wherein, a structure of said peripheral portion around said ink supply port and a structure of said peripheral portion around said air communicating port are provided so that said air communicating port is opened prior to opening of said ink supply port when removing said seal member by peeling off said one seal member, a peeling off force of said one seal member acting on both of said peripheral portion around said air communicating port and said peripheral portion around said ink supply port, said structures being formed of a generally circular rib which surrounds said ink supply port and a polygonal shaped rib which surrounds said air communicating port, respectively, and said polygonal shaped rib surrounding said air communicating port is formed of a polygonal shape having an outer dimension that is larger than an outer diameter of said generally circular rib surrounding said ink supply port.

8. A replaceable ink cartridge according to claim 7, wherein a direction of peeling said seal member is regulated via an extension of said seal member which extends from positions of said structures surrounding said ink supply port and said air communicating port, respectively.

9. A replaceable ink cartridge according to claim 8, wherein, at least a portion of said extension of said seal member is bonded with a packaging member which wraps said casing, and upon opening of said packaging member, said extension, together with said packaging member, is regulated to a limited peeling direction.

* * * * *

UNITED STATES PATENT AND TRADEMARK OFFICE

CERTIFICATE OF CORRECTION

PATENT NO. : 6,382,785 B2
DATED : May 7, 2002
INVENTOR(S) : Inada et al.

It is certified that error appears in the above-identified patent and that said Letters Patent is hereby corrected as shown below:

Title page,
Item [*], insert the following:

-- [*] Notice: This patent issued on a continued prosecution application filed under 37 CFR 1.53(d) and is subject to the twenty year patent term provisions of 35 U.S.C. 154(a)(2). --

Column 1,
Line 24, “as” (first occurrence) should be deleted;
Line 31, “being” should read -- be --; and
Line 63, “droplets,” should read -- droplet, --.

Column 2,
Line 6, “easily” should read -- easy --;
Line 11, “original,” should read -- an original --;
Line 12, “of” should read -- of a --;
Line 30, “qualities” should read -- quality --;
Line 32, “referred” should read -- referred to --;
Line 52, “removable” should read -- removably --;
Line 53, “them” should read -- them to -- and “in the” should read -- in --;
Line 55, “removable” should read -- removably --; and
Line 58, “An” should read -- A --.

Column 3,
Line 64, “the both” should read -- both the --.

Column 4,
Line 19, “bring” should read -- bringing --;
Line 43, “open” should read -- opening --;
Lines 50, 54 and 61, “striping” should read -- stripping --;
Line 57, “in an” should read -- in a -- and “striping” should read -- stripping --; and
Line 64, “near” should read -- nearer --.

Column 5,
Line 55, “strip” should read -- stripping --; and
Lines 56 and 65, “striping” should read -- stripping --.

UNITED STATES PATENT AND TRADEMARK OFFICE

CERTIFICATE OF CORRECTION

PATENT NO. : 6,382,785 B2
DATED : May 7, 2002
INVENTOR(S) : Inada et al.

It is certified that error appears in the above-identified patent and that said Letters Patent is hereby corrected as shown below:

Column 6,
Lines 2, 6, 10 and 14, “striping” should read -- stripping --; and
Line 29, “with” should read -- with the --.

Column 7,
Line 28, “of an” should read -- of a --; and
Line 45, “OF” should read -- OF THE --.

Column 8,
Line 1, “are” should read -- is --;
Line 18, “films,” should read -- film --; and
Line 51, “square.” should read -- a square. --.

Column 9,
Line 3, “open” should read -- opening --;
Line 8, “5a” should read -- 5 --;
Lines 13 and 16, “referred” should read -- referred to --;
Line 43, “because of” should read -- because --;
Line 62, “atmospheric” should read -- atmosphere --; and
Line 65, “pore 3” should read -- port 3 --.

Column 10,
Line 2, “more easily” should read -- easier --;
Line 16, “ways, for” should read -- ways. For --;
Line 24, “ways” should read -- way --;
Line 45, “referred” should read -- referred to --;
Line 49, “in” should be deleted; and
Line 56, “shown” should read -- shown in --.

Column 11,
Line 13, “concerned” should read -- concern --;
Line 23, “methods” should read -- method --;
Line 32, “refer” should read -- refer to --; and
Line 57, “including” should read -- includes --.

Column 12,
Line 5, “are” should read -- is --;
Line 6, “remained” should read -- remaining --;
Line 30, “his or her” should read -- he or she --;
Line 37, “be occurred” should read -- occur --;

UNITED STATES PATENT AND TRADEMARK OFFICE

CERTIFICATE OF CORRECTION

PATENT NO. : 6,382,785 B2
DATED : May 7, 2002
INVENTOR(S) : Inada et al.

It is certified that error appears in the above-identified patent and that said Letters Patent is hereby corrected as shown below:

Column 12 cont'd,
Line 39, "FIGS. 14A-C" should read -- FIGS. 14a to 14C --;
Line 55, "make sure" should read -- assures --;
Line 57, "an" should be deleted; and
Line 67, "make more sure" should read -- assures --.

Column 13,
Line 5, "of the" (second occurrence) should be deleted;
Line 6, "In the" should read -- In --;
Line 16, "by a" should read -- by --;
Line 19, "do" should read -- are --;
Line 21, "shapes" should read -- shape --; and
Line 60, "numeral" should read -- numeral 1A --.

Column 14,
Line 36, "is not located" should read -- ends --;
Line 39, "flesh" should read -- fresh --;
Line 59, "have" should read -- has --; and
Line 60, "as of" should read -- as that of --.

Column 15,
Line 2, "where" should read -- where lies --;
Line 8, "open" should read -- opening --;
Line 35, "it is" should read -- there is --;
Line 38, "open" should read -- opening --;
Line 41, "consider" should read -- considering --;
Line 45, "open" should read -- opening --;
Line 46, "peel" should read -- peeling --;
Line 49, "that of" should read -- that --;
Line 51, "be occurred" should read -- occur -- and "is spite" should read -- despite --;
Line 55, "of" should be deleted; and
Line 57, "that of" should read -- that --.

Column 16,
Line 17, "open" should read -- opening --;
Line 19, "in spite" should read -- despite --;
Line 27, "color" should read -- collar --;
Line 31, "and a" should read -- and an --; and
Line 33, "that" should read -- that of --.

UNITED STATES PATENT AND TRADEMARK OFFICE

CERTIFICATE OF CORRECTION

PATENT NO. : 6,382,785 B2
DATED : May 7, 2002
INVENTOR(S) : Inada et al.

It is certified that error appears in the above-identified patent and that said Letters Patent is hereby corrected as shown below:

Column 17,
Line 38, "110c." should read -- cartridge holder 110c. --; and
Line 43, "of" should be deleted.

Column 18,
Line 31, "ink," should read -- ink --.

Signed and Sealed this

Sixth Day of May, 2003

JAMES E. ROGAN
*Director of the United States Patent and Trademark Office*